US007357123B2

(12) United States Patent
Maekawa et al.

(10) Patent No.: US 7,357,123 B2
(45) Date of Patent: Apr. 15, 2008

(54) ELECTROMAGNETIC ACTUATOR, FUEL INJECTION VALVE, METHOD OF CONTROLLING FUEL INJECTION VALVE, AND METHOD OF DRIVING THE SAME

(75) Inventors: Noriyuki Maekawa, Kasumigaura (JP); Motoyuki Abe, Hitachinaka (JP); Kenchiro Tokuo, Hitachinaka (JP); Takehiko Kowatari, Kashiwa (JP); Tohru Ishikawa, Kitaibaraki (JP); Toshiyuki Innami, Mito (JP); Kazuhiko Hanawa, Hitachinaka (JP); Satoshi Shimada, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 22 days.

(21) Appl. No.: 11/288,196

(22) Filed: Nov. 29, 2005

(65) Prior Publication Data

US 2006/0180122 A1 Aug. 17, 2006

(30) Foreign Application Priority Data

Feb. 14, 2005 (JP) ..... 2005-035368

(51) Int. Cl.
*F02M 69/46* (2006.01)

(52) U.S. Cl. ..... 123/490; 73/119 A; 701/104; 701/115

(58) Field of Classification Search ..... 701/103–105, 701/115; 123/490, 399; 73/119 A
See application file for complete search history.

(56) References Cited

U.S. PATENT DOCUMENTS 5,575,264 A * 11/1996 Barron ..... 123/486
6,651,629 B2 * 11/2003 McCoy et al. ..... 123/480
6,904,354 B2 * 6/2005 Kuegel et al. ..... 701/104
2002/0099492 A1 7/2002 Okawa et al.

FOREIGN PATENT DOCUMENTS

| | | | |
|---|---|---|---|
| DE | 102 13 349 | A1 | 10/2003 |
| DE | 102 51 031 | A1 | 5/2004 |
| DE | 103 12 914 | A1 | 10/2004 |
| EP | 0 771 942 | A1 | 5/1997 |
| JP | 10-306735 | A | 11/1998 |
| JP | 2003-301741 | A | 10/2003 |
| WO | WO 03/081353 | A1 | 10/2003 |
| WO | WO 03/091560 | A1 | 11/2003 |
| WO | WO 2004/086158 | A1 | 10/2004 |

OTHER PUBLICATIONS

European Search Report dated Jun. 9, 2006 (Five (5) Pages).
Engine Technology vol. 4, Jul. 2002, p. 84-89 (2002).

* cited by examiner

*Primary Examiner*—Erick Solis
(74) *Attorney, Agent, or Firm*—Crowell & Moring LLP

(57) ABSTRACT

Information storage element 102 and transmitter-receiver 103 are molded in resin connector part 101 of fuel injection valve 100 which projects outside of the engine by molding. The precise control of an injection amount is enabled by using directly the characteristic of injection amount stored in information storage element 102, and obtaining the width of the injection command pulse corresponding to the injection amount instruction value. Thereby, the minimum injection amount which is the minimum value of the fuel supply amount which can be controlled is reduced.

5 Claims, 27 Drawing Sheets

FIG. 3

| | INJECTION COMMAND PULSE VALUE Ti (ms) | DYNAMIC INJECTION AMOUNT q ($mm^3$) |
|---|---|---|
| 301 | T1 | q1 |
| | T2 | q2 |
| | ⋮ | ⋮ |
| | Tn1 | qn1 |
| 302 | Tn2 | qn2 |
| | ⋮ | ⋮ |
| | Tn3 | qn3 |
| 303 | Tn4 | qn4 |
| | ⋮ | ⋮ |
| | Tn5 | qn5 |
| 304 | STATIC INJECTION AMOUNT | Qst |

INTERNAL CONFIGURATION OF ID TAG

ELECTROMAGNETIC ACTUATOR, FUEL INJECTION VALVE, METHOD OF CONTROLLING FUEL INJECTION VALVE, AND METHOD OF DRIVING THE SAME

BACKGROUND OF THE INVENTION

The present invention relates to a sensor for measuring various physical values, and an electromagnetic actuator for adjusting various physical values, more concretely to a motor-driven throttle valve device installed for instance in an internal combustion engine or a compression ignition oil engine, an AFS (Airflow sensor) which detects the flow rate, a throttle valve position sensor which detects the rotating angle degree of the valve, a fuel injection valve which controls the amount of fuel supply, a high-pressure pump which supplies fuel to the fuel injection valve, a motor for an electric automobile, or a rotation sensor (Popular name: a resolver) which detects the rotation of a motor by detecting the position of a magnetic pole of a rotator of the motor concerned, and further to a control method or a driving method.

In general, so-called ID tags or ID tag systems are known, where a storage element storing the attestation code for article attestation with a receiver (Which may contain an antenna) is installed in the article, and information on the birth of the article concerned and the effect are read with a non-contact type reader.

The technology mentioned below is known in a fuel injection valve for an internal combustion engine. An individual attestation code is provided to the surface of the fuel injection valve by marking using the laser. Further, ROM is provided to the drive unit. The attestation code is read by reading out the marking with a code reader, and the injection characteristic of the corresponding fuel injection valve is stored in a ROM as individual data. The individual data is read out from this ROM by the engine control management, and the individual difference between fuel injection valves is counterbalanced by correcting the controlled variable of the fuel injection valve specified by the attestation code.

Further, the technology which displays individual data to show an injection characteristic to fuel injection valve itself by bar code, and the technology which installs a ROM in the fuel injection valve itself, and stores individual data to show the injection characteristic to the ROM are known (For instance, refer to Japanese Patent Application Laid-Open No. 2003-301741).

Moreover, the technology that the correction circuit is built into a sensor housing to correct the variation of characteristics due to the individual difference of the airflow rate measurement element is known in the sensor (Airflow sensor) which measures the amount of intake air in an internal combustion engine for an automobile. (For instance, refer to Engine technology, Vol. 21, July 2002, pp 84-89).

Moreover, the composite part like the electric throttle body which integrates sensors such as the airflow sensor is disclosed. (Japanese Patent Application Laid-Open No. 10-306735)

BRIEF SUMMARY OF THE INVENTION

However, both an attestation code of the individual and specific data of the characteristic of the individual could not be read from the individual by non-contact in the above-mentioned prior art. Therefore, there was a time-consuming problem in connection with the association work among the writing work of data to a storage element, the attestation of the individual and the specific data of the characteristic of the individual concerned.

An object of the present invention is to solve the above-mentioned problem, and to provide a means which can read the attestation code and the specific data of the characteristic directly from a sensor or an electromagnetic actuator by non-contact.

To achieve the above-mentioned object, so-called ID tag which comprises a receiver (Which may include an antenna) and a storage element in a resin body of a sensor or an electromagnetic actuator as an individual is installed in the present invention.

Here, the ID tag means at least eight kinds of ID tags which have been described in documents other than the above-mentioned patent.

And, attestation code and operating characteristics information on one individual corresponding to the code concerned is stored in this ID tag.

In case of a fuel injection valve, the operating characteristics information is, for example, an injection amount characteristic to the stroke in the minute flow rate area which could not be used so far.

In a motor-driven throttle valve device, it is the correlation information between the zero point of a throttle valve opening sensor which detects the opening of the valve and zero opening position of the throttle valve.

In a certain case, it is the correlation between the fixed opening from closed position, so-called save running opening (It is also called default opening) and the output value of the sensor corresponding to it, and the correlation between the open position of the opening and the output value of the sensor corresponding to it.

Moreover, in a motor-driven throttle valve (Normally full open) device used for the compression ignition oil engine, the operating characteristics information is the correlation between open position of the opening and the output signal (Ex. voltage value) of the sensor corresponding to it.

Signal information on the singular point showing the maximum value or the minimum value is acceptable for operating characteristics information in case of the throttle axis rotating angle degree detection sensor (Alias TPS: throttle position sensor) which detects the opening of the throttle valve. Moreover, signal information at some specific positions of all areas is acceptable.

When the sensor is a sliding resistance type, the operating characteristics information can be a signal which relates to the change in the voltage drop according to the resistance change. The operating characteristics information relates to the generation voltage of a Hall element corresponding to the change in the magnetic field from the magnet when the Hall IC is used.

The operating characteristics information is the information which relates to the difference of the position between the changes (Sine wave) in the phase voltages of a motor and the rectangular wave trigger signal for a rotation sensor (Resolver).

Moreover, there is operating characteristics information for the intake airflow rate sensor of an internal combustion engine (Airflow sensor).

The storage form of these operating characteristics information can be given as a map (Table) or be given as a coefficient of equations.

The operating characteristics information is time required for the valve to arrive at a fixed position after a capacity changeable control valve is turned on (It is called delay time) for a high-pressure fuel pump.

Concrete configuration when applying to the fuel injection valve is as follows.

A fuel injection valve including an information storage part where information corresponding to the characteristic of injection amount is stored, wherein the information stored in said information storage part are values of dynamic injection amounts corresponding to widths of a plurality of injection command pulses, and the interval of the set points of the widths of the plural injection command pulses in the area where a dynamic injection amount is small is relatively smaller than the interval of the widths of the plural injection command pulses in the area where dynamic injection amount is large.

Further, in a fuel injection valve including an information storage part where information corresponding to the characteristic of injection amount is stored, the information stored in said information storage part are values of dynamic injection amounts corresponding to the set points of the widths of the plural injection command pulses and values of static injection amounts.

Further, in a method of controlling a fuel injection valve including an information storage part where information corresponding to the characteristic of injection amount is stored, the injection amount in the minute injection amount area is controlled by obtaining directly the width of an injection command pulse corresponding to a injection amount instruction value based on said information.

Further, in a method of controlling a fuel injection valve, specific information to specify the fuel injection valve is given to the individual, and information on the characteristic of said fuel injection valve is acquired from the outside of the engine in which said fuel injection valve is provided, based on said specific information.

Further, in a fuel injection valve with connector part made of resin which projects outside of an engine while installed in the engine, an information storage element and a transmitter-receiver is molded as one in said connector part made of resin.

Further, in a method of controlling a fuel injection valve which supplies the fuel used to burn once in the engine in multiple fuel injections, at least one time fuel injection is controlled by using at least one of the above-mentioned fuel injection valve and the above-mentioned control method.

An individual attestation code of the individual of the sensor or the electromagnetic actuator and operating characteristics can be read out easily by non-contact according to the present invention Therefore, the adjustment operation and the correction procedure in the program become easy.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings:

FIG. 3 is a diagrammatic illustration explaining one embodiment of information input to fuel injection valve according to the present invention.

DETAILED DESCRIPTION OF THE INVENTION

An example of a fuel injection valve will be explained in detail as follows.

EMBODIMENT 1

Figure 1:
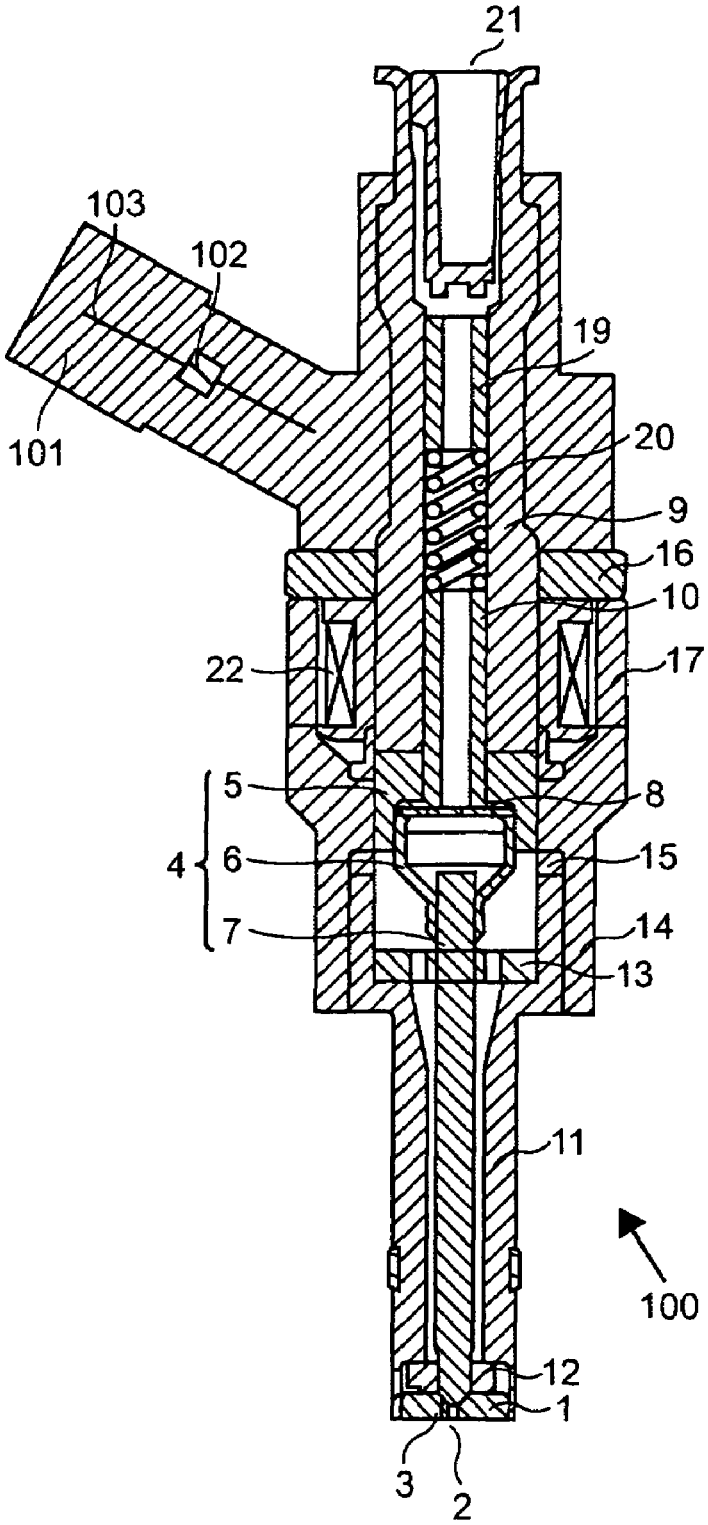
FIG. 1 is a sectional view showing one embodiment of fuel injection valve according to the present invention.
Figure 2:
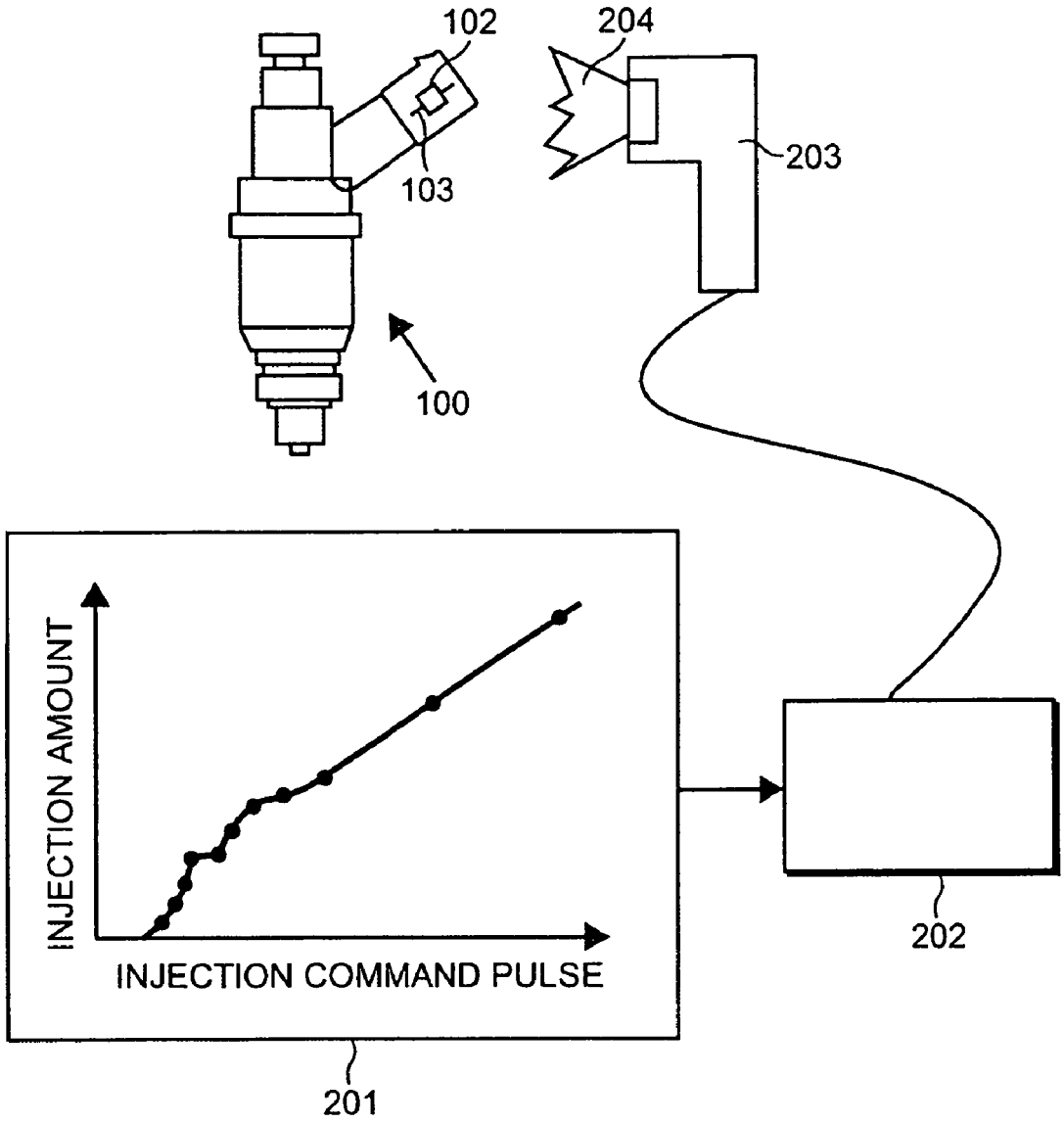
FIG. 2 is a diagrammatic illustration explaining one embodiment of an information input method of fuel injection valve according to the present invention.

(FIG. 1 and FIG. 2 . . . antifouling, waterproofs, guarantee of vibration resistance, and data entry is possible after assemble)

A first embodiment of the fuel injection valve according to the present invention is explained by using FIG. 1 and FIG. 2.

Configuration and basic operation of the fuel injection valve of the present invention are explained by using FIG. 1 in the beginning.

FIG. 1 is a sectional view showing a first embodiment of the fuel injection valve of the present invention.

Fuel injection hole 2 and valve seat 3 are provided to orifice plate 1. Orifice plate 1 is fixed at the point of nozzle holder 11 by a method of welding etc. Swirler 12 for turning the fuel is provided between orifice plate 1 and nozzle holder 11. Moreover, guide plate 13 is fixed inside of nozzle holder 11. Valve body 4 is slid and guided by the inside diameter part of swirler 12 and the hole provided at the center part of guide plate 13.

Valve body 4 is made by uniting moving core 5, cylindrical member 6 and rod 7 by the method of the welding etc. As for dumper plate 8 provided in moving core 5, its outer part is supported by the top side of cylindrical member 6 for the vertical direction. Interlocking member 10 is supported to slide axially inside inner fixed core 9. The point of interlocking member 10 is touched to the external part in dumper plate 8. Dumper plate 8 functions as a leaf spring because the external part is supported and the internal part can be bent axially.

Nozzle holder 11 is fixed inside of nozzle housing 14. Ring 15 to adjust the stroke of valve body 4 is provided to the top part of nozzle holder 11. Spring pin 19 is fixed inside of inner fixed core 9. Spring 20 is provided while compressed with the bottom part of spring pin 19 being assumed to be a fixed end. The spring force is transferred to valve body 4 through interlocking member 10 and dumper plate 8 to press valve body 4 against valve seat 3. The fuel supplied from the fuel supply port 21 stays in the fuel injection valve because the fuel passage is shut in this state of the close valve, and the fuel is not injected from fuel injection hole 2.

Nozzle holder 14, moving core 5, inner fixed core 9, plate housing 16 and external fixed core 17 make a magnetic circuit in the surroundings of coil 22.

When the injection command pulse turns on, the electric current flows to coil 22, moving core 5 is attracted to inner fixed core 9 by electromagnetic force, and valve body 4 moves to the position where its top side comes in contact to the bottom side of inner fixed core 9. The turn power is given to the fuel supplied from fuel injection hole 2 by swirler 12 because the space can be formed between valve body 4 and valve seat 3 in this state of an open valve, and the fuel is injected from fuel injection hole 2.

Valve body 4 returns to the state of the close valve by the spring force because the electric current does not flow to coil 22, and electromagnetic force disappears, and the fuel injection ends when the injection command pulse enters an "off" state.

Working of the fuel injection valve is to control the amount of fuel supply by switching the position of valve body 4 like the above-mentioned between the state of the open valve and the state of the close valve according to the injection command pulse, and to adjust time to continue the state of the open valve.

It is necessary to correct the variation of fuel injection amount due to the individual difference of the fuel injection valve to control precisely the amount of fuel supply, and reduce the minimum injection amount which is the minimum value of the fuel supply amount which can be controlled.

Therefore, information storage element 102 and transmitter-receiver 103 are provided in connector part 101 made of resin, which projects outside of the engine while installed in the engine in the fuel injection valve of the present invention. It is desirable that information storage element 102 is an IC chip semiconductor chip such as memory chips. It is desirable that transmitter-receiver 103 is an antenna. Information storage element 102 and transmitter-receiver 103 are molded as one in connector part 101 made of resin. Preferably, information storage element 102 and transmitter-receiver 103 are buried in connector part 101 made of resin. Characteristic information on the characteristics of injection amount etc. of an individual fuel injection valve can be input to information storage element 102. The characteristic information be transmitted outside of the fuel injection valve through transmitter-receiver 103, and received from the outside of the fuel injection valve.

Because information storage element 102 and transmitter-receiver 103 are buried by molding in connector part 101 made of resin, the corrosion such as oil, water, and dirt which exist in the vicinity of the engine and the stains can be prevented according to such configuration. Moreover, the engine vibration transferred to information storage element 102 and transmitter-receiver 103 is decreased by the effect of vibration damping of the member of connector part 101 made of resin. As a result, the damage and deterioration due to the vibration can be prevented, and it become possible to maintain the function for a long term Next, an information input method to information storage element 102 is explained by using FIG. 2. It is desirable to adopt the tag which can read and write data as information storage element 102. Characteristic information 201 measured about an individual fuel injection valve is input to computer 202 such as personal computers. The input information is input to information storage element 102 of the fuel injection valve by information input device 203. When inputting, it is assumed that information input device 203 and information storage element 102 is non-contact. Characteristic information is transmitted by information transmission medium 204 such as electric waves, and is taken into information storage element 102 through transmitter-receiver 103 such as antennas.

According to such configuration, only the information storage element 102 in which the characteristic is not input is provided in the assembly process of fuel injection valve 100. The characteristic is examined after the assembly of fuel injection valve 100 ends, and the characteristic test result can be input to information storage element 102 at that time. Therefore, the design for the mass production process becomes easy.

The light detecting element is acceptable for information transmission medium 204, and the photo sensing element is acceptable for transmitter-receiver 103.

EMBODIMENT 2

Figure 4:
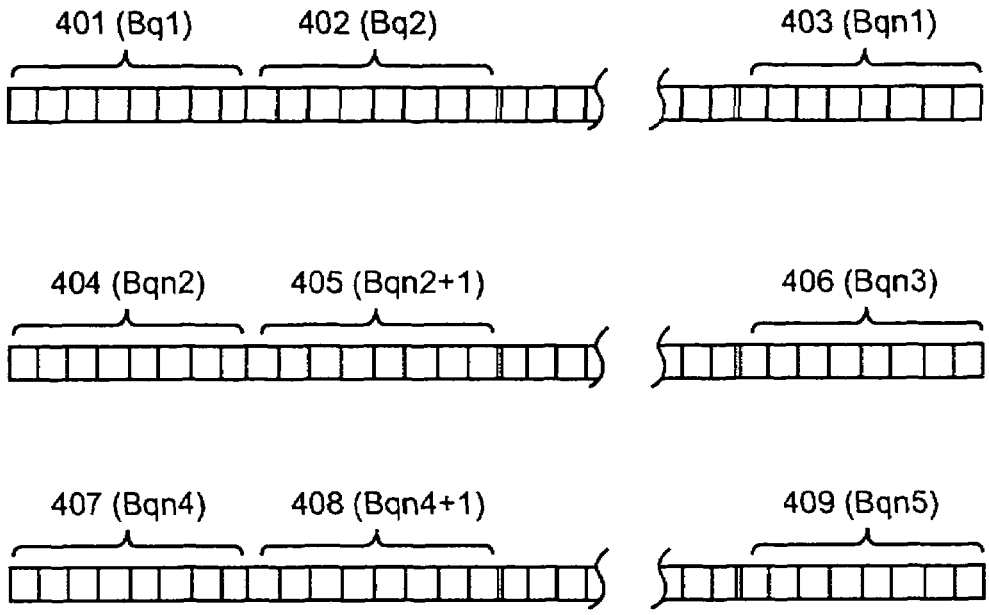
FIG. 4 is a diagrammatic illustration explaining one embodiment of information input to fuel injection valve according to the present invention.

(FIG. 3 and FIG. 4 . . . it is possible to decrease an information amount and obtain fine information in the position where the variation is large.)

Next, a second embodiment of the fuel injection valve according to the present invention is explained by using FIG. 3 and FIG. 4.

FIG. 3 is a diagrammatic view showing one example of the information input to above-mentioned information storage element 102.

The measurement value of a dynamic injection amount which is an injection amount when the fuel injection is performed by inputting the width of each injection command pulse in connection with an individual fuel injection valve is input to information storage element 102. It is desirable to divide the area of dynamic injection amount into small area 301, middle area 302 and large area 303, etc. as shown in FIG. 3. Further, how to divide is not limited to such three-division, but it is desirable to a plurality of areas. In small area 301 of the dynamic injection amount, the interval of the set point of the width of the injection command pulse by which the dynamic injection amount is measured is set more narrowly than middle area 302. Further, in middle area 302, the interval of the width of the set point of the injection command pulse by which the dynamic injection amount is measured is set more narrowly than area 303 where injection amount is large. For instance, the interval of each set point in T1-Tn1 is the narrowest in the example of FIG. 3, and the interval of each set point in Tn2-Tn3 is the second narrowest. The interval of each set point in Tn4-Tn5 is the widest.

Thus, it is possible to make the information on the dynamic injection amount close in the minute injection amount area where the variation is large by changing the interval of the set point of the width of the injection command pulse in each area. As a result, the dynamic injection amount of the minute injection area can be controlled precisely. It becomes possible to decrease the amount of information of the dynamic injection amount in the injection amount area where the variation is relatively small at the same time, and to reduce the information capacity stored in information storage element 102.

Further, it is possible to input static injection amount Qst which is an injection amount per unit time when the fuel injection valve is kept in the state of an open valve to static injection amount input line 304.

Omitting the information on the dynamic injection amount of area 303 where the variation is small, that is, the injection amount is large by inputting static injection amount Qst becomes possible, and the information capacity stored in information storage element 102 can be further reduced.

FIG. 4 is a diagrammatic view showing the concrete example of how to arrange the information input to information storage element 102. Each square bottom type shown in FIG. 4 indicates each bit of information storage element 102. The value of the width of the injection command pulse need not be input, and only the order of the set point has to decide beforehand. For instance, binary number data Bq1 which corresponds to dynamic injection amount q1 when the width of the injection command pulse is T1 is stored in storage area 401. Moreover, binary number data Bq2 which corresponds to dynamic injection amount q2 when the width of the injection command pulse is T2 is stored in storage area 402, and so forth.

Further, because the value of the width of the injection command pulse need not be input, the information capacity stored in information storage element 102 can be reduced in such an input method.

Next, the relational expression of value q of the actual dynamic injection amount and binary number data Bq which corresponds to its value is described. The following relationship is approved in connection with small area 301 of the above-mentioned dynamic injection amount.

$$q1 = k1 \times Bq1 \quad \text{(Equation 1)}$$

The following relationship is approved in connection with the above-mentioned middle area 302.

$$qn2 = k2 \times Bqn2 \quad \text{(Equation 2)}$$

The following relationship is approved in connection with area 303 where the above-mentioned dynamic injection amount is large.

$$qn4 = k3 \times Bqn4 \quad \text{(Equation 4)}$$

Here, it is assumed that the conversion factor to convert the binary number data into the dynamic injection amount is a value different in each area to become the following relationship.

$$k1 < k2 < k3 \quad \text{(Expression 5)}$$

That is, conversion factor k1 in the area of small dynamic injection amount is reduced most, conversion factor k2 in the middle area is next reduced, and conversion factor k3 in the area where the dynamic injection amount are large is enlarged most.

In the minute injection amount area, the injection amount data can be stored with high-resolution without increasing the number of bits by reducing conversion factor k1. On the other hand, inputting a large numerical value without increasing the number of bits becomes possible by enlarging conversion factor k3 in the area where the injection amount is large.

EMBODIMENT 3

Figure 5:
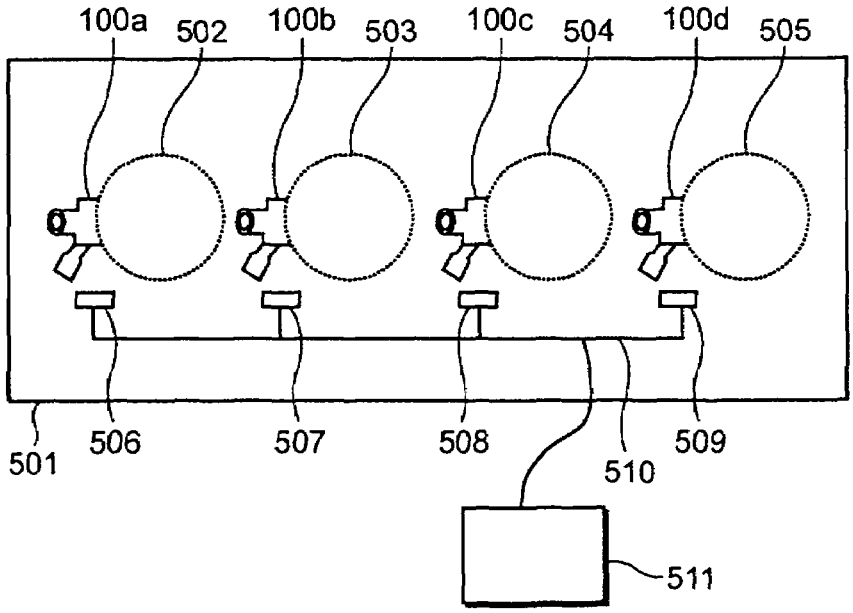
FIG. 5 is a diagrammatic illustration explaining one embodiment of engine equipped with fuel injection valve according to the present invention.
Figure 6:
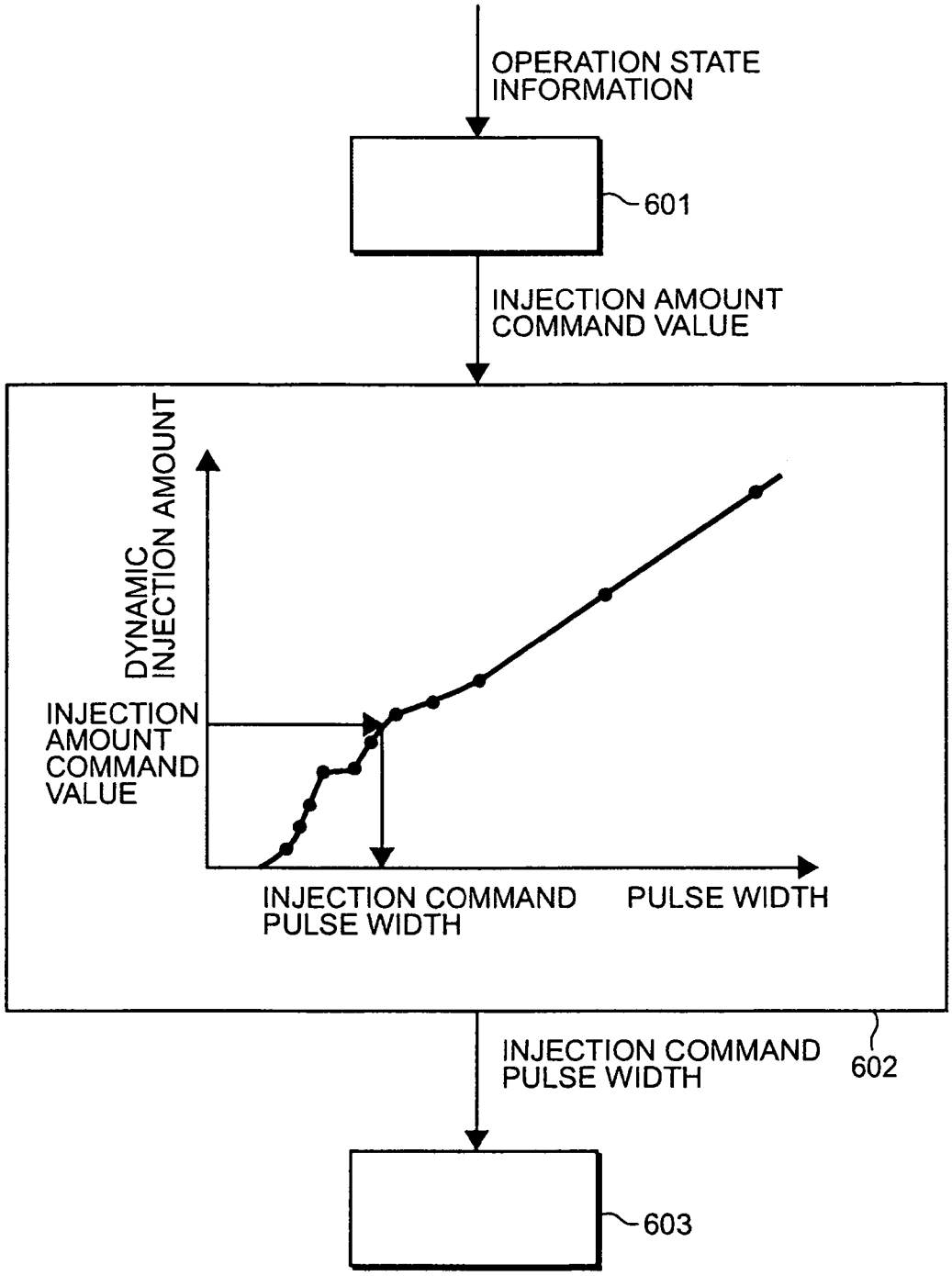
FIG. 6 is a diagrammatic illustration explaining one embodiment of a method of controlling fuel injection valve of the present invention.
Figure 7:
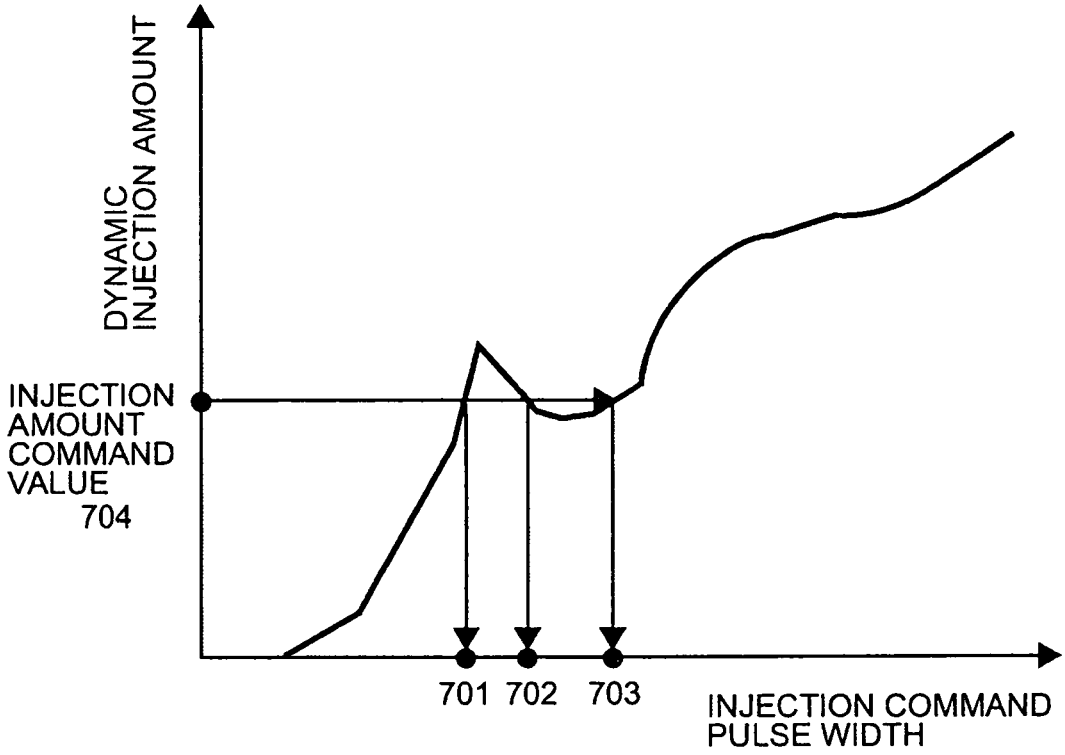
FIG. 7 is a diagrammatic illustration explaining details of a method of controlling fuel injection valve of the present invention.

(FIG. 5, FIG. 6 and FIG. 7 . . . It is possible to expand the region where the minute injection amount can be controlled.)

Next, a third embodiment of the method of controlling the fuel injection valve according to the present invention is explained by using FIG. 5 to FIG. 7. FIG. 5 is a diagrammatic view showing the engine system configuration which uses one embodiment of the fuel injection valve of the present invention and the control method thereof.

Fuel injection valves 100*a* to 100*d* are installed in cylinders 502 to 505 of engine 501, respectively. Information reading parts 506 to 509 are provided in the neighborhood of fuel injection valves 100*a* to 100*d*. Information reading parts 506 to 509 are connected with engine control unit 511 through signal wire 510.

It is possible to prevent the adverse effect due to noise, etc. in the engine room when the information is read by providing information reading parts 506 to 509 in the neighborhood of fuel injection valves 100*a* to 100*d* like this. Moreover, even when the energy of the electric wave which the information storage element sends is small, the reliable transmitting of the information becomes possible.

Next, one embodiment of the method of controlling the fuel injection valve according to the present invention is explained by referring to FIG. 6.

FIG. 6 shows the information processing flow in the engine control unit.

Injection amount instruction value operation part 601 inputs operating state information on the load and the number of the revolutions of the engine, etc. from sensors (Not shown) of the engine, and outputs an instruction value of the necessary injection amount. The information on the dynamic injection amount about the width of the injection command pulse of each of fuel injection valve 100*a* to 100*d* is taken into the engine control unit through information reading part 506 to 509. In the injection command pulse width operation part, the best width of the injection command pulse to obtain the dynamic injection amount which is accurately corresponding to the injection amount instruction value is obtained directly based on the above-mentioned dynamic injection amount information by assuming the injection amount instruction value to be an input. The width of the injection command pulse is sent to driving circuit 603 of the fuel injection valve, and an electric current (Not shown) is supplied to the fuel injection valve.

Because the best width of the injection command pulse is obtained directly in such a control method based on individual dynamic injection amount information on the fuel injection valve to obtain the dynamic injection amount which is accurately corresponding to the injection amount instruction value, the minimum injection amount which is the minimum value of the fuel supply amount which can be controlled can be reduced without being influenced by the variation of the characteristic of an individual fuel injection valve in the minute injection area.

The effect to reduce the minimum injection amount is not achieved though there is a method of increasing or decreasing the pulse width of the injection command pulse provided beforehand in consideration of the characteristic of an individual fuel injection valve, too.

Reducing the minimum injection amount becomes possible according to the feature of obtaining the best width of the injection command pulse by using the value of the dynamic injection amount measured for the width of the injection command pulse in the minute injection amount area in the control method of the present invention.

The control method of the fuel injection valve according to the present invention is explained more in detail by using FIG. 7. FIG. 7 is an enlarged view showing the relationship between the width of the injection command pulse and the dynamic injection amount in the minute injection amount area. The case where the dynamic injection amount does not become a monotonous increase is shown. In this case, the width of the injection command pulse to obtain the dynamic injection amount which corresponds to injection amount instruction value 704 for instance will exist by three points like points 701 to 703. In this case, the point where the inclination to the width of the injection command pulse of the dynamic injection amount is minimum is selected. Point 703 is selected for FIG. 7.

It becomes possible to decrease more the repetition variation of the dynamic injection amount by selecting the point where the in clination of the dynamic injection amount is small, and to control precisely the injection amount.

Although information reading parts 506 to 509 is provided in the neighborhood of fuel injection valves 100*a* to 100*d* in FIG. 5, signal wire 510 etc. can be simplified by providing the information reading part in the engine control unit (ECU).

EMBODIMENT 4

Figure 8:
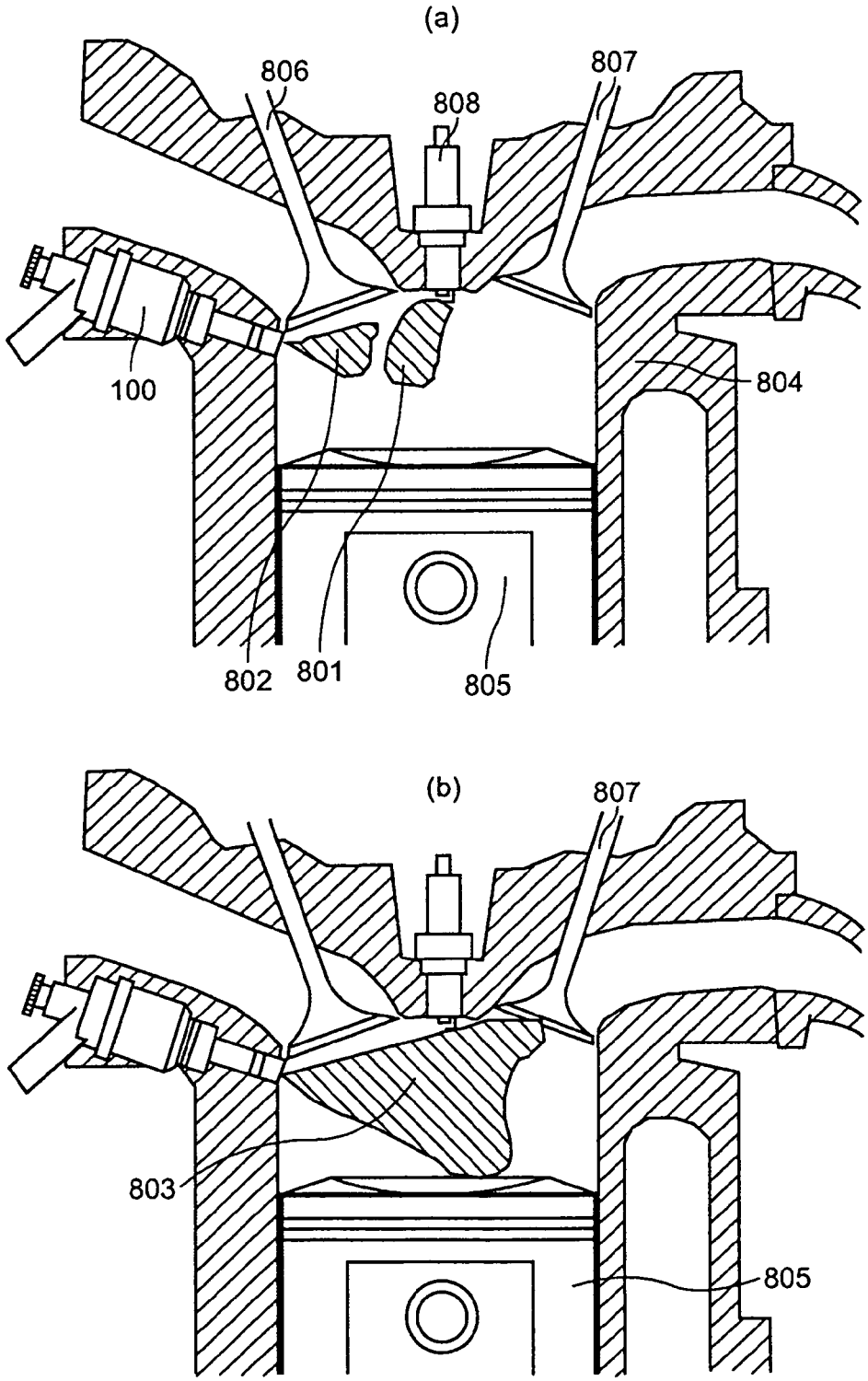
FIG. 8 is a diagrammatic illustration explaining another embodiment of a method of controlling fuel injection valve of the present invention.

Next, a fourth embodiment of the control method of the fuel injection valve according to the present invention is explained by using FIG. 8.

FIG. 8(*a*) is a diagrammatic view showing the method of controlling the fuel injection valve of the present invention. Piston 805, intake air valve 806, exhaust valve 807, and sparking plug 808, etc. are provided to cylinder 804 of the engine. In the cylinder injection engine, fuel injection valve 100 is provided directly to cylinder 804.

In the method of controlling the fuel injection valve of the present invention, the fuel amount necessary for one combustion is injected in plural times. FIG. 8(*a*) shows the case where the fuel is injected in twice. It is possible to distribute the fuel divided into the first atomization 801 and the second atomization 802 in cylinder 804. At least one fuel injection among the fuel injections of plural times is controlled by using one or more of the methods of controlling the fuel injection valve shown in the embodiments 1 to 3.

FIG. 8(*b*) shows conventional atomization 80 when the fuel necessary for one combustion is injected in one time for the comparison. The length of atomization might become long too much in conventional atomization 803, and as a result, the fuel might adhere to the end face of exhaust valve 807 and piston 805 and the inner wall of cylinder 804.

Because the fuel necessary for one combustion is divided into the minute fuel injection amount of plural times and injected in the method of controlling the fuel injection valve of the present invention. The length of atomization can become shorter, and the fuel can be prevented from adhering to the inner wall of cylinder 804 and the end face of exhaust valve 807 and piston 805. As a result, harmful components in the exhaust gas such as hydrocarbons can be decreased.

EMBODIMENT 5

Figure 9:
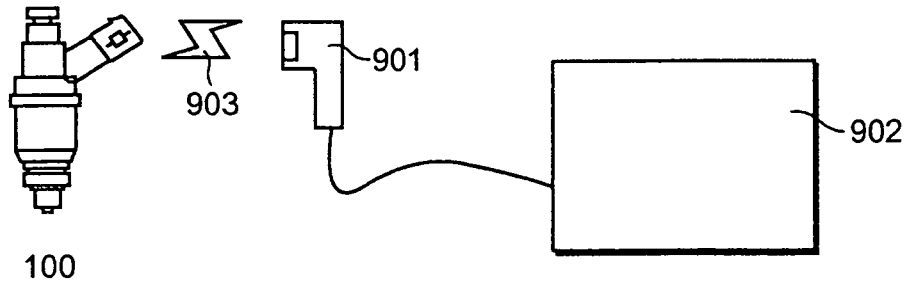
FIG. 9 is a diagrammatic illustration explaining a part of assembly procedure of fuel injection valve of the present invention to an engine.
Figure 10:
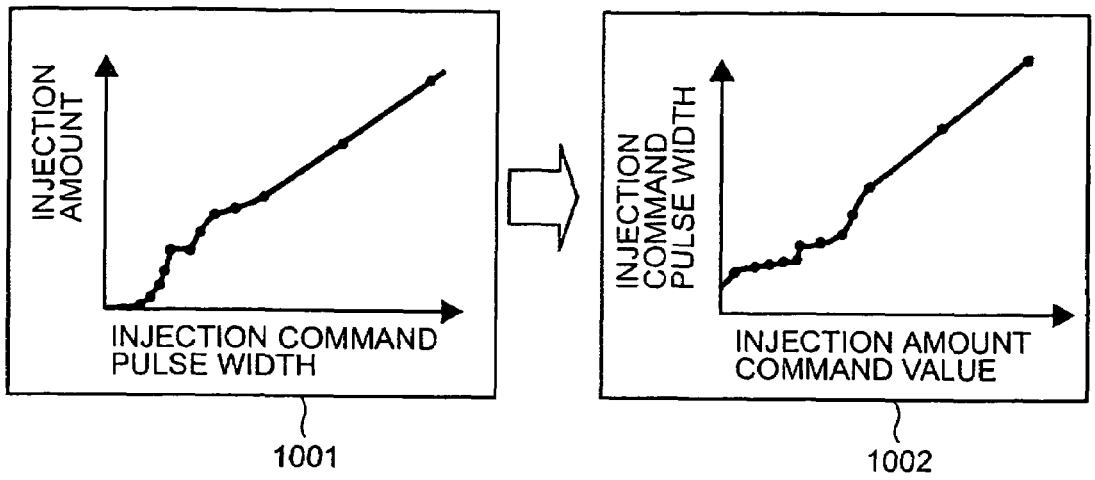
FIG. 10 is a diagrammatic illustration explaining a part of assembly procedure of fuel injection valve of the present invention to an engine.
Figure 11:
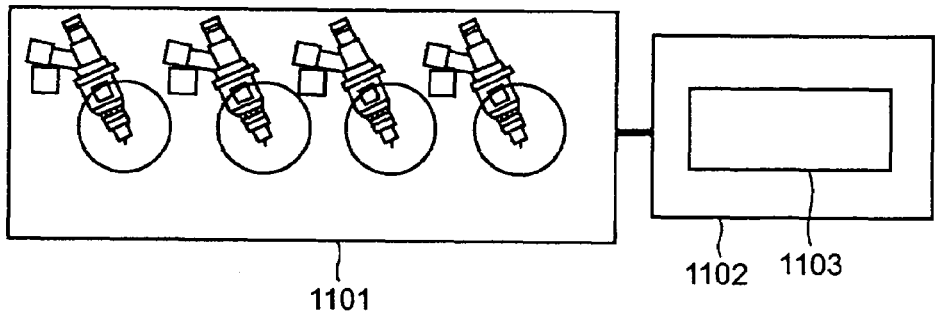
FIG. 11 is a diagrammatic illustration explaining a part of assembly procedure of fuel injection valve of the present invention to an engine.
Figure 13:
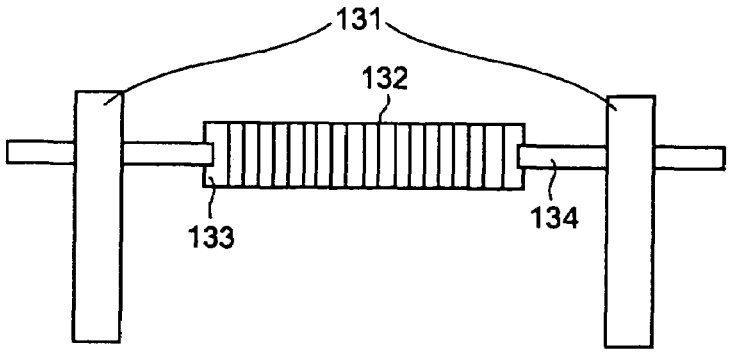
FIG. 13 is an explanatory drawing of an airflow rate sensor.

Next, a fifth embodiment of the control method the fuel injection valve of the present invention is explained by using FIG. 9 to FIG. 11. FIG. 9 to FIG. 11 sequentially shows the process where the engine with a fuel injection valve of the present invention is assembled.

First of all, as shown in FIG. 9, the characteristic of the injection amount of fuel injection valve 100 is read by using information reader 901. It is desirable to use electric wave 903 for the information reading. Read information is stored in computer 902 such as personal computers.

Next, basic information 1001 showing the relationship between the width of the injection command pulse and injection amount is converted into conversion information 1002 indicative of the relationship between the injection amount instruction value and the injection command pulse width in computer 902 as shown in FIG. 10.

Next, the above-mentioned conversion information 1002 is stored in information storage 1103 provided in engine control unit 1102 connected with engine 1101 as shown in FIG. 11.

The width of the injection command pulse most suitable for obtaining the dynamic injection amount which is accurately corresponding to the injection amount instruction value can be obtained directly even by such configuration. The minimum injection amount which is the minimum value of the fuel supply amount which can be controlled can be reduced without being influenced by the variation of the characteristic of an individual fuel injection valve in the minute injection area.

Because the information need not be transmitted between the fuel injection valve and engine control unit 1102, the reader and the wiring, etc. can be simplified. Therefore, a low-cost and precise fuel injection system can be achieved.

EMBODIMENT 6

Figure 12:
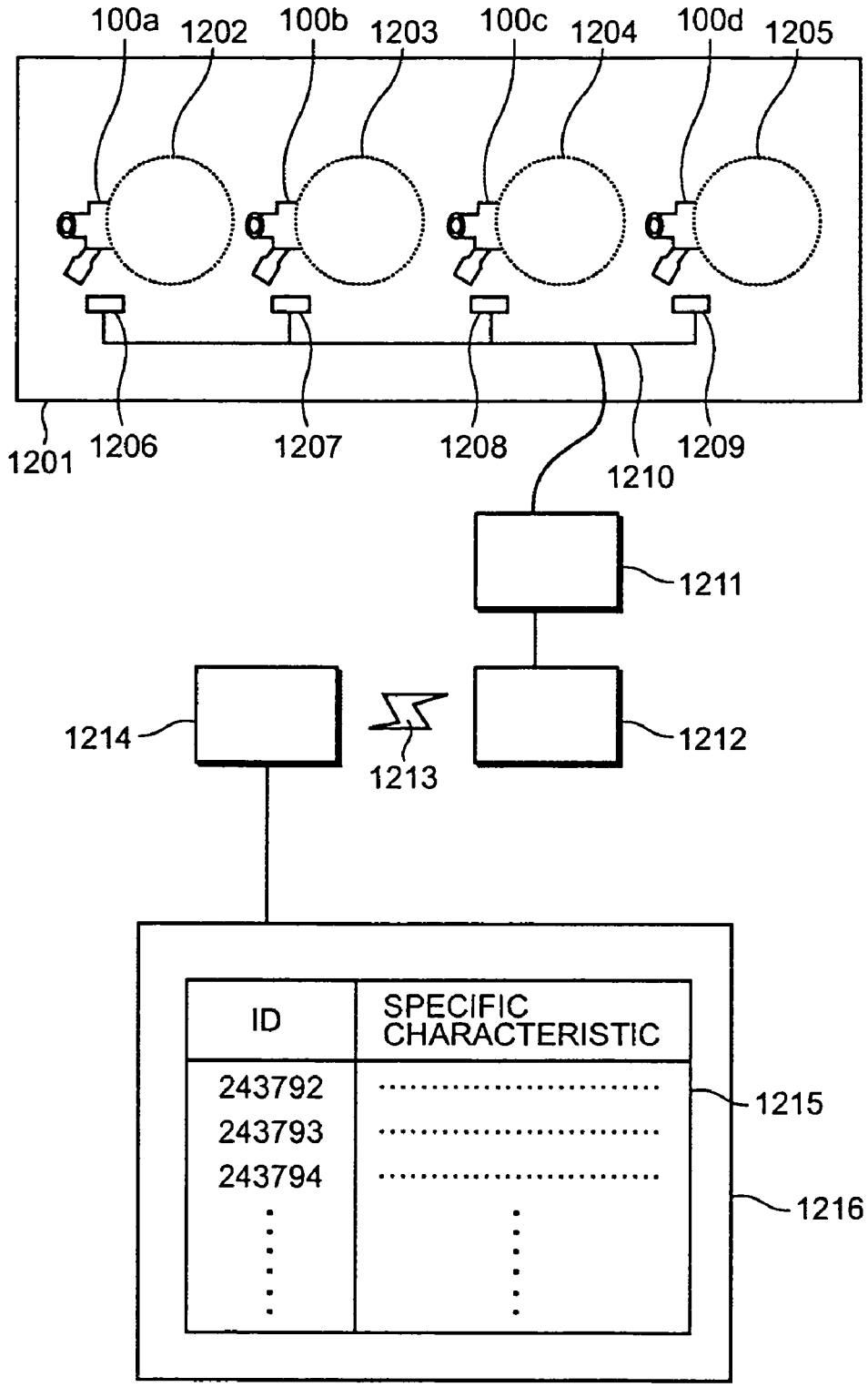
FIG. 12 is a diagrammatic illustration explaining another embodiment of a method of controlling fuel injection valve of the present invention.

(FIG. 12 . . . The handling of mass data is possible)

Next, sixth embodiments of the fuel injection valve and the control method of the present invention are explained by using FIG. 12.

Fuel injection valves 100*a* to 100*d* are installed in cylinders 1202 to 1205 of engine 1201, respectively. Information reading parts 1206 to 1209 are provided in the neighborhood of fuel injection valves 100*a* to 100*d*, respectively. Information reading parts 1206 to 1209 are connected with engine control unit 1211 through signal wire 1210 in order. Further, engine control unit 1211 is connected with vehicle transmitter-receiver 1212 provided in the vehicle. It is preferable that vehicle transmitter-receiver 1212 is an antenna.

Management center 1216 which manages characteristic information 1215 on the fuel injection valve is provided outside of the vehicle, and management transmitter-receiver 1214 is provided in management center 1216. It is preferable that management transmitter-receiver 1214 is an antenna.

Only ID information which corresponds to the identification number to identify the individual is given to fuel injection valves 100*a* to 100*d*. Each ID information is taken into engine control unit 1211 through information reading parts 1206 to 1209 and signal wire 1210. Engine control unit 1211 transmits the above-mentioned ID information to management transmitter-receiver 1214 through information medium 1213 such as electric waves from vehicle transmitter-receiver 1212. Management center 1216 transmits the characteristic information which corresponds to the ID information which has been sent to vehicle transmitter-receiver 1212 through information medium 1213 such as electric waves from management transmitter-receiver 1214.

Thus, the characteristic information on the individual of each of fuel injection valve 100*a* to 100*d* can be obtained from the outside of the vehicle.

According to this method, it is possible to take mass characteristic information into engine control unit 1211 without being restricted by the memory capacity of the information storage medium provided in fuel injection valves 100*a* to 100*d*, and to control the engine more precisely. The following effects exist according to this embodiment.

Because the best width of the injection command pulse is obtained directly in such a control method based on individual dynamic injection amount information on the fuel injection valve to obtain the dynamic injection amount which is accurately corresponding to the injection amount instruction value, the minimum injection amount which is the minimum value of the fuel supply amount which can be controlled can be reduced.

The present invention is explained in detail as follows in case of the airflow sensor.

EMBODIMENT 7

The airflow rate sensor is a sensor which measures the intake airflow inhaled into each cylinder in the electronically controlled gasoline injection system. Air-fuel ratio which is the ratio of the intake airflow and the fuel amount is the most important factor which decides the exhaust gas characteristic and the fuel consumption characteristic in the engine. It is necessary to control precisely the air-fuel ratio to clean exhaust gas, and to drive with good fuel consumption. It is required for the airflow sensor to measure the intake airflow with a high precision and high reliability for that purpose.

In the hot wire type airflow rate sensor, heating resistor 132 which consists of a platinum line or a platinum thin film is heated with the electric current supplied, and the fact that the amount of the heat transfer from the heating resistor to air depends on the flow velocity of air is used.

Figure 15:
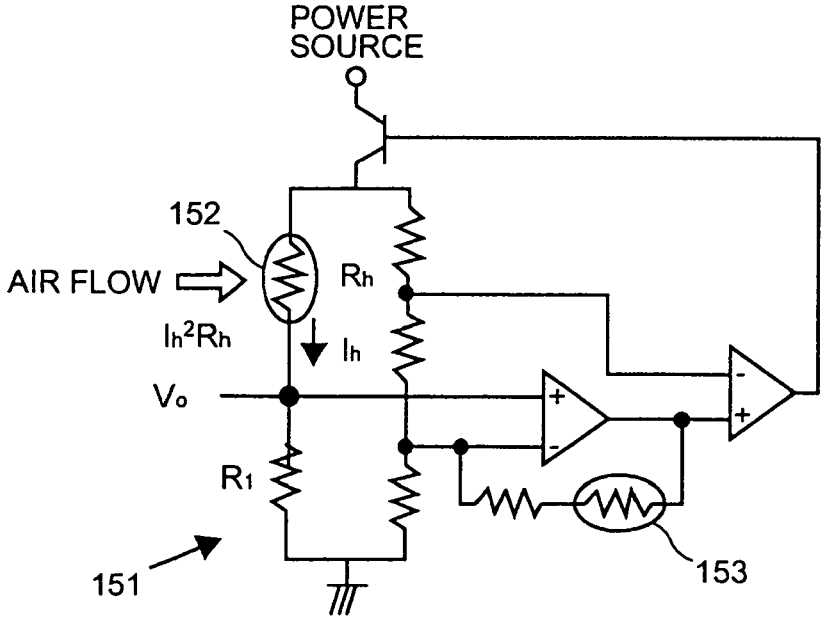
FIG. 15 is a circuit diagram of an airflow rate sensor.

As shown in FIG. 15, bridge 151 is composed of hot wire probe 152 which detects the airflow rate and temperature probe 153 which detects the temperature of air, and the electric current supplied to hot wire probe 152 is increased and decreased so that the temperature gradient of both does not depend on the airflow rate, but become constant almost. Voltage drop Vo of resistance R1 corresponding to the supply electric current is detected as an airflow rate signal.

The relationship between the airflow rate and the output signal is shown by King's expression (Expression 1) indicative that the electric current is in proportion to fourth-power root of airflow rate Ga from the relationship between the calorific value amount and the heat radiation amount of hot wire probe 152.

Figure 16:
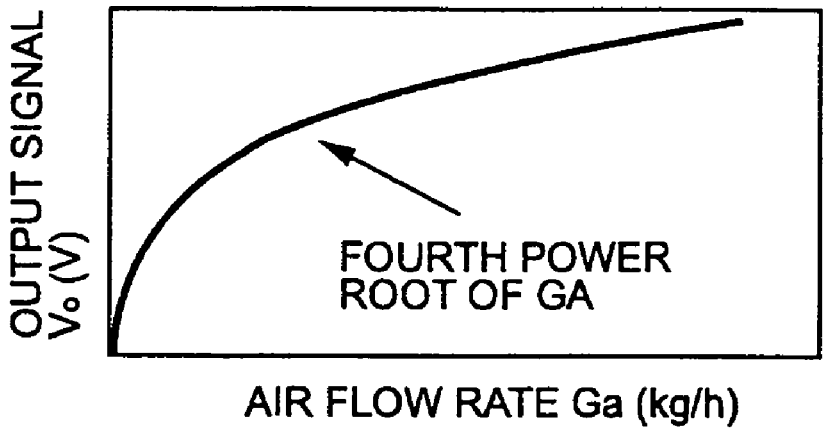
FIG. 16 is an explanatory drawing of an airflow rate sensor.
Figure 17:
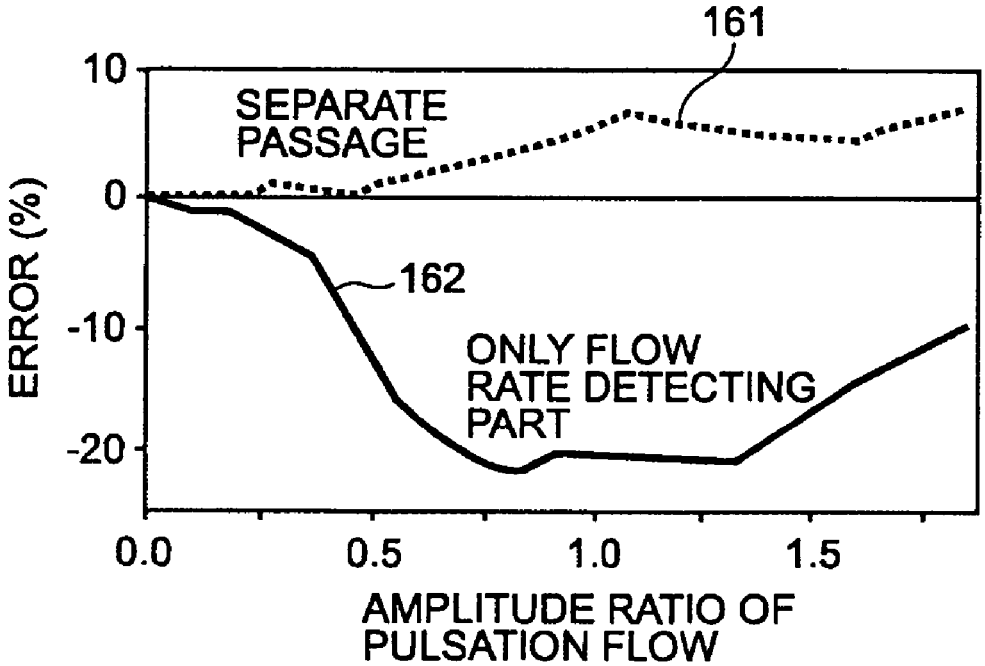
FIG. 17 is an explanatory drawing of an airflow rate sensor.
Figure 18:
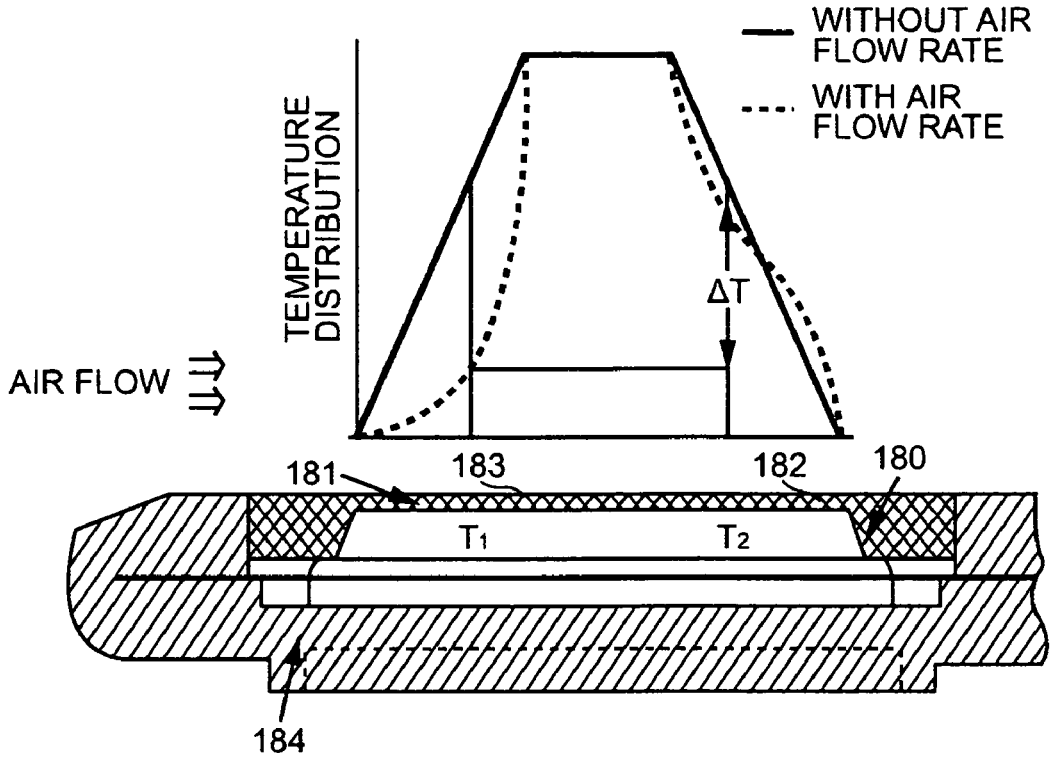
FIG. 18 is an explanatory drawing of an airflow rate sensor.

Output voltage Vo detected as the voltage drop of resistance Rh by electric current Ih is obtained from Vo=Ih·R1 shown in FIG. 15. The value becomes a curve similar to the logarithm characteristic that the signal change is large at low flow velocity (Low airflow rate) as shown in FIG. 16.

$$Ih^2 \cdot Rh = A + B \times Ga^{1/2} \quad (1)$$

Figure 14:
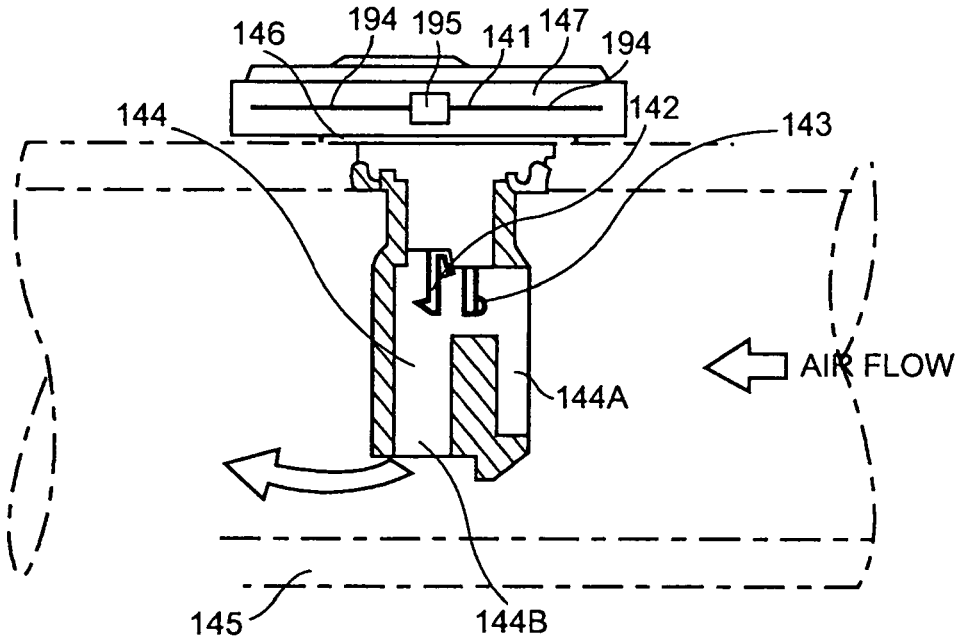
FIG. 14 is an explanatory drawing of an airflow rate sensor.

Here, Ih: Electric current supplied to the hot wire probe, Rh: Resistance of hot wire probe, R1: Voltage detection resistance, Ga: Mass airflow rate, and A, B: Constant. To facilitate the mounting on the inlet pipe, hot wire probe 142, branch passage 144 (Called bypass), (Branch passage entrance 144A and branch passage exit 144B) and electronic circuit 141 are formed as one like FIG. 14, and detecting element is plugged from hole 146 provided in the sidewall of the intake air passage to inlet pipe 145.

The variation of the sectional area of the inlet pipe is corrected automatically by the air-fuel ratio closed loop control with an air-fuel ratio sensor installed in the exhaust pipe and the closed loop control correction.

However, it is difficult in the direct-injection engine, the diesel engine, and the engine where VVT (Electromagnetic-drive type intake valve) and EGR (Exhaust gas return current device) were adopted to measure airflow rate accurately because there are further a lot of backflows.

Then, the characteristic correction multiplier is measured in advance according to each specification of the engine such as a direct-injection engine, a diesel engine, the engine in which VVT (Electromagnetic-drive type intake valve) or EGR (Exhaust gas re-circulation) is used. The information is stored in the ID tag of each of the airflow rate sensors. Injection amount corresponding to the airflow rate is calculated in the engine control unit according to the information read from the ID tag after building in the engine.

The information read from the ID tag is similar to the case of the above-mentioned fuel injection valve.

The role of the airflow rate sensor explained above is to detect precisely the air amount inhaled into the cylinder every engine cycle. Air amount of the cylinder is obtained by integrating the airflow rate sensor signal during the intake stroke. However, because the pressure in downstream part of the throttle changes when the throttle is rapidly opened and closed at the time of the deceleration or the acceleration of the organization, It is necessary to correct the change in air amount according to this change in pressure by the computer.

In a word, the airflow rate with good accuracy is not obtained by the airflow sensor alone at the unsteady operation in which the throttle valve is opened or closed rapidly, for example, at the time of the deceleration or the acceleration of the engine.

Figure 19:
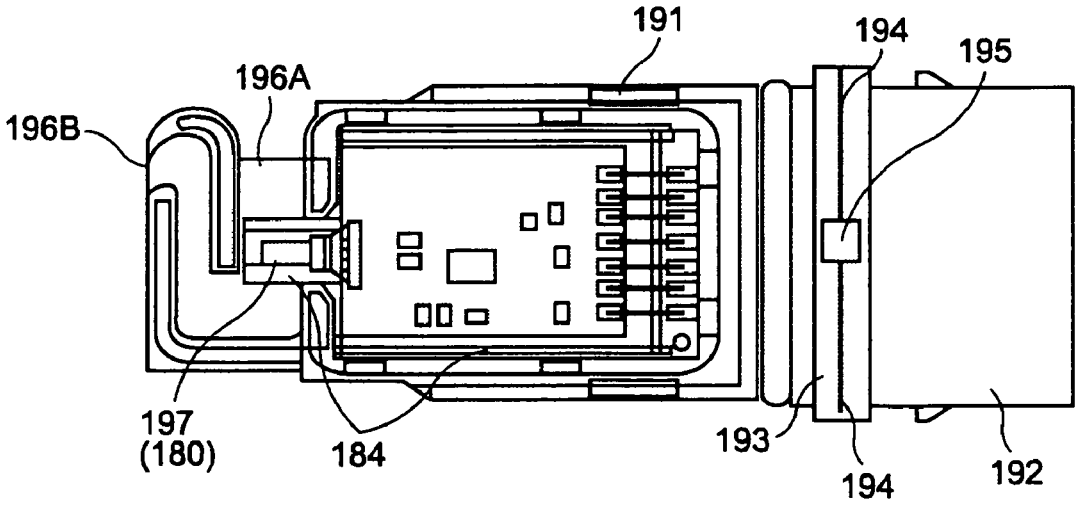
FIG. 19 is a view showing an airflow rate sensor.

Therefore, the air amount characteristic according to the pressure change in the downstream part of the throttle when the throttle is opened or closed rapidly is measured beforehand as an assembly module of the sensor and the throttle valve in the application of the present invention. The specific ID code and the measurement result of the air amount characteristic which is the specific operating characteristics of the sensor and the valve actuator module are stored in the memory of ID tag 195 with antenna 194 installed in the airflow rate sensor (147 of FIG. 14), the connector (192 of FIG. 19), guard (193 of FIG. 19*s*) or the resin case of the module.

The engine control unit corrects the air amount when the throttle is rapidly opened and closed based on measurement result information on the air amount characteristic as specific ID code and the specific operating characteristics stored in the ID tag read with the reader. As a result, the fuel amount and the ignition time at the time of the deceleration or the acceleration can be obtained with a high accuracy.

The airflow rate characteristic to the output voltage shown in FIG. 16 is different in each sensor. Then, this basic characteristic is stored in the memory of the ID tag as specific operating characteristics with a specific attestation code in the embodiment of the present invention.

Concretely, output voltage value Vomin when the airflow rate is zero is stored as a zero point voltage. The amount of a shift is stored as an offset voltage when there is the shift from the zero point voltage. The storage value is used in the following operation or when the map is read.

The output voltage values at several specific points are stored in the memory of the ID tag as specific operating characteristics with specific attestation codes, so that the change in the output voltage when a standard airflow rate for the characteristic measurement is gradually changed may be recognized as the characteristic shown in FIG. 16

Or, the output voltages of several specific points are measured, and the inclinations between those specific points are stored in the memory of the ID tag as specific operating characteristics with specific attestation codes. Thus, the output voltage values at several specific points, indicative of the stored specific operating characteristics are read from the ID tag by specifying the attestation code. As a result, the output of the airflow rate sensor is corrected by the memory information provided in the circuit of the airflow rate sensor or the controller of one valve sensor module.

Specific operating characteristics are written as a map or a table. Or, if the operating characteristics are the characteristics shown by an equation (Expression), it is stored as a coefficient of the equation.

Thus, because the difference of accuracy due to various operating characteristics of the airflow rate sensor can be adjusted even after the sensor is installed in the automobile, the intake airflow rate signal is obtained with high accuracy. As a result, harmful components of the exhaust gas are decreased or the drive with the improved fuel consumption becomes possible.

The case motor-driven throttle valve device is explained by using FIG. 20 to FIG. 23.

EMBODIMENT 8

Known is the technique that an initial opening (Default opening) of the throttle valve when the engine key is turned off (In other words, when the electric actuator is tuned off) is set to more than closed position in an electronically controlled throttle device which controls throttle valve for controlling the intake airflow of an internal combustion engine by electric actuator (For instance, direct current motor and stepping motor).

Here, closed position of the throttle is not the meaning of the position where the intake air passage is completely closed. Especially, the mechanical close position and the electrical close position as described next are defined in the throttle device to control idling speed only with the throttle without providing the by-pass passage which makes a detour around the throttle.

The mechanical close position is the minimum opening position of the throttle provided by the stopper. To prevent the galling of the throttle, this minimum opening is set at the position opened somewhat from the position where the intake air passage is completely closed. Electrical close position is the minimum opening within the range of opening used in the control, and is set at a slightly large opening position on the basis of mechanical close position (For instance, the position which is about 1° larger than mechanical close position).

In an electronically controlled throttle, the electrical close position (Minimum opening in the control) and the idling opening (Opening necessary for controlling the idling speed) are not necessarily corresponding. The reason is that the idling opening has the width, because the feedback control of the throttle opening is performed based on idling speed detection signal in order to keep the idling speed in target number of revolutions.

There are the mechanical open position provided by the stopper and the electric open position which is maximum opening in the control also for the open position. Here, both electrical close position and mechanical close position are contained when called simply the closed position. In usual control, the throttle is controlled from electrical close position (Minimum opening in the control) to the electric open position (Maximum opening in the control). According to such control, a part of the throttle axis never collides with the stopper which provides mechanical close position and the mechanical open position, and mechanical fatigues, wears or damages of the stopper and the throttle parts, can be prevented. Moreover, the galling to the stopper can be prevented.

The default opening (That is, the initial opening when the engine key is tuning off.) is set to the opening at the position (For instance, the position opened from the mechanical close position by 4-13°) where the throttle is opened more than the above-mentioned closed position (Mechanical close position and electrical close position).

The reason that the default opening is set is as follows. One reason is to secure the airflow rate necessary for the combustion in the operation (Cold start-up) performed before the warm up at the engine starting without providing an auxiliary air passage (Air passage which bypasses the throttle valve). When idling, the throttle is controlled so that it goes to the direction (However, electrical close position is a lower bound position) which is narrowed from default opening as the throttle valve is warmed up.

Additionally, the setting of the default opening is effective to prevent the throttle from sticking to the inner wall of the throttle body with viscous materials and ices, etc., to secure an intake airflow rate to prevent the engine stall, and to secure the self-running (Limp home), should the throttle control system break down.

Concretely, it comprises as follows.

Figure 20:
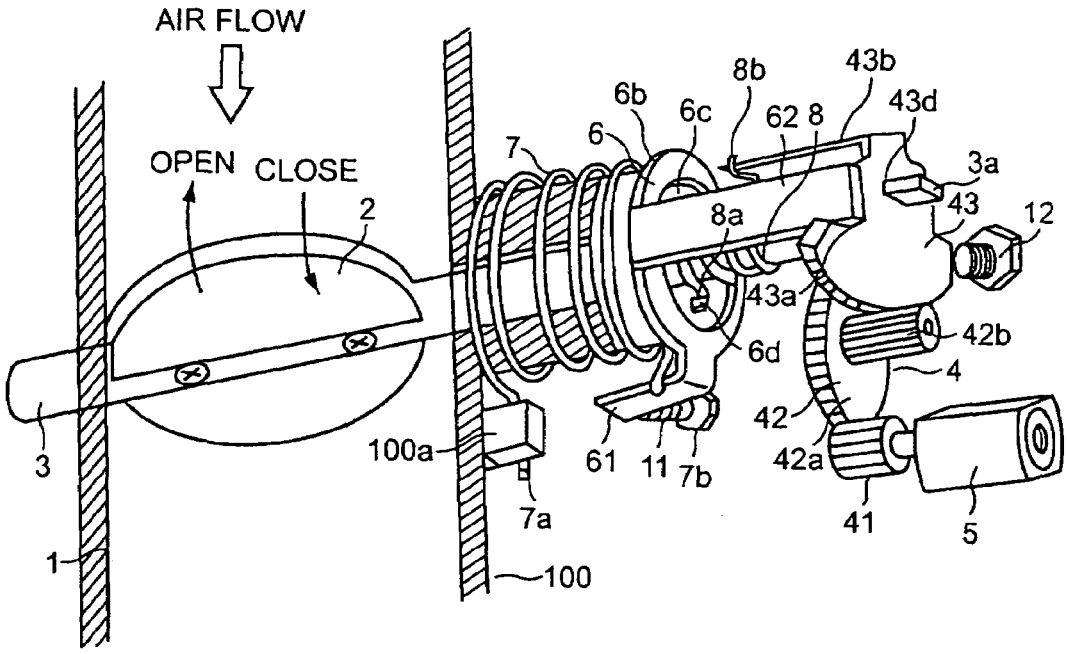
FIG. 20 is an illustration explaining the principle of an electronically controlled throttle device with a default mechanism.
Figure 25:
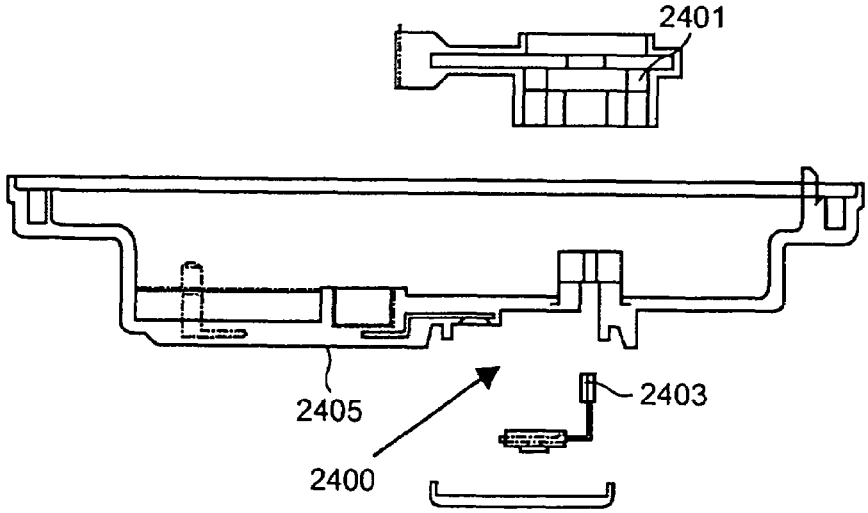
FIG. 25 is a view showing a throttle sensor which detects opening of throttle valve.
Figure 21:
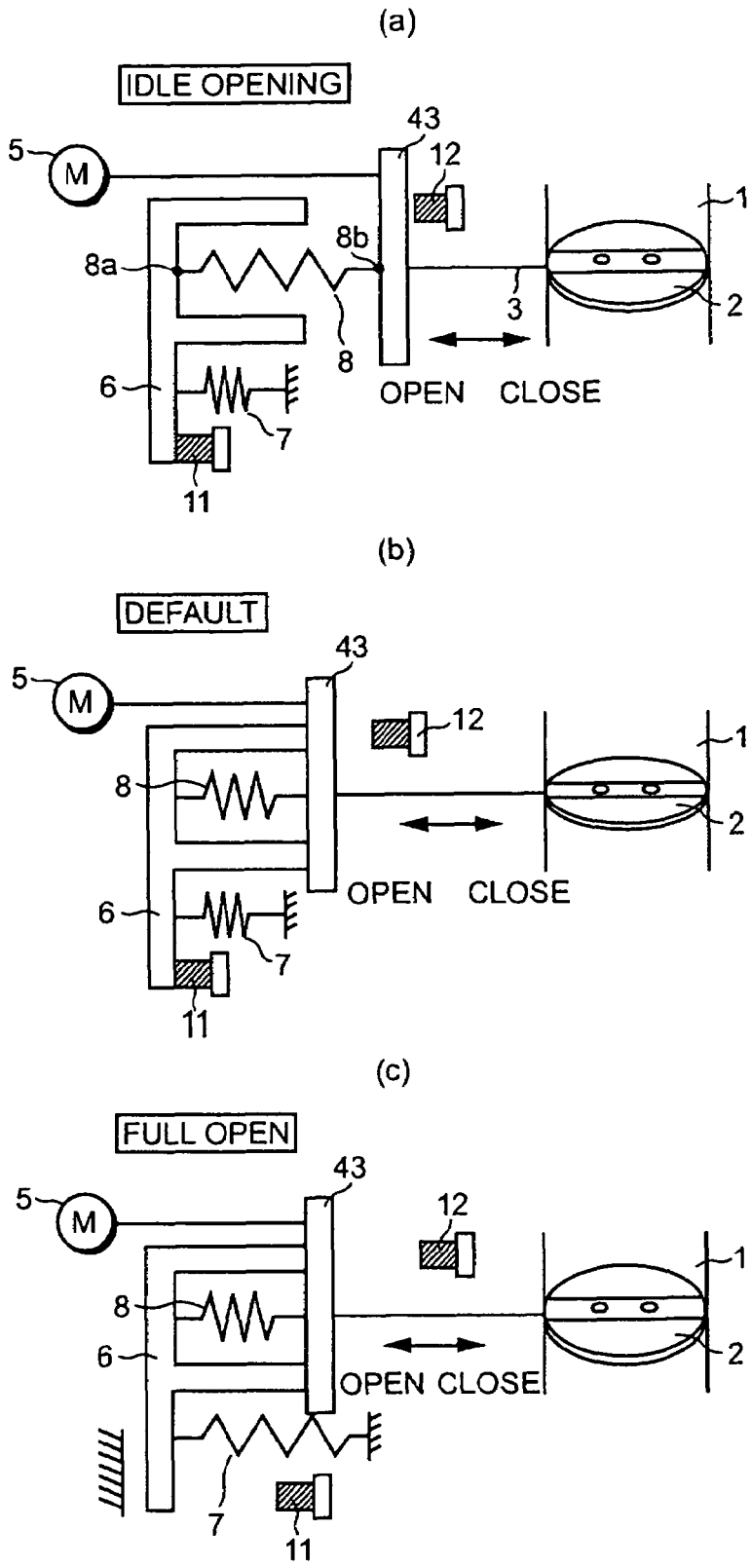
FIG. 21 is an illustration explaining the principle of an electronically controlled throttle device with a default mechanism.

The principle of the electronically controlled throttle device (Throttle device of the internal combustion engine for an automobile) with the default mechanism according to one embodiment is explained by using FIG. 20 and FIG. 21. FIG. 20 is a perspective view showing the power transfer and the default mechanism of the throttle in this embodiment. FIG. 21 is a principle explanatory drawing showing the equivalent operation.

In FIG. 20, the airflow rate in the direction of the arrow which flows in intake air passage 1 is adjusted according to the opening of disc throttle valve 2 (Throttle valve). Throttle valve 2 is fixed to throttle axis 3 by a screw. Final gear 43 (Hereafter, it is called a throttle gear) of deceleration gear mechanism 4 which transfers the power of motor 5 (Electric actuator) to throttle axis 3 is installed at the end of throttle axis 3.

Gear mechanism 4 comprises pinion gear 4 fixed to motor 5 and middle gear 42 besides throttle gear 43. Middle gear 42 comprises gear 42*a* of larger diameter which engages with pinion gear 41 and gear 42*b* of smaller diameter which engages with throttle gear 43. Middle gear 42 is fitted rotatably to gear shaft 70 (Refer to FIG. 22) fixed to the wall of throttle body 100.

Motor 5 is driven according to the accelerator signal indicative of the amount of depressing of the acceleration pedal and the traction control signal. The power of motor 5 is transferred to throttle axis 3 through gears 41, 42, and 43.

Throttle gear 43 is a sartorial gear, fixed to throttle axis 3. This gear has engaging portion 43*a* which engages with raised portion 62 of default lever 6 described next.

Default lever 6 is used for default opening set mechanism (Engagement element for setting the default opening). This lever engages rotatably with the throttle axis 3 relatively. As for throttle gear 43 and default lever 6, one end 8*a* of spring 8 (Hereafter, it is occasionally called a default spring) is engaged by spring engagement part 6*d* of default lever 6. The other end 8*b* is engaged by spring engagement part 43*b* provided to throttle gear 43. Raised portion 62 on the side of default lever 6 and engaging portion 43*a* on the side of the throttle gear 43 are energized so as to attract to (Engage with) each other in a rotation direction through default spring 8. When seen from closed position of the throttle, default spring 8 energizes throttle axis 3 and further throttle valve 2 in the direction of default opening.

Return spring 7, which gives the return power in the closing direction of throttle 3 engages default lever 6, throttle gear 43 engaged with the default lever, and throttle axis 3 in the closing direction of the throttle. One end part 7*a* (Fixed end) of return spring 7 is engaged with spring engagement part 100*a* fixed to throttle body 100, and the other free end part 7*b* is engaged spring engagement part 61 (Raised portion) provided to default lever 6.

In FIG. 20, the projection degree of the raised portions 61, 62 of default lever 6, and spring engagement part 43*b* provided in throttle gear 43 is exaggerated for the sake of convenience of the drawings. Actually, because springs 7 and 8 are compressed and the axial length of the spring is shortened, it is formed by the corresponding small raised portion.

Figure 22:
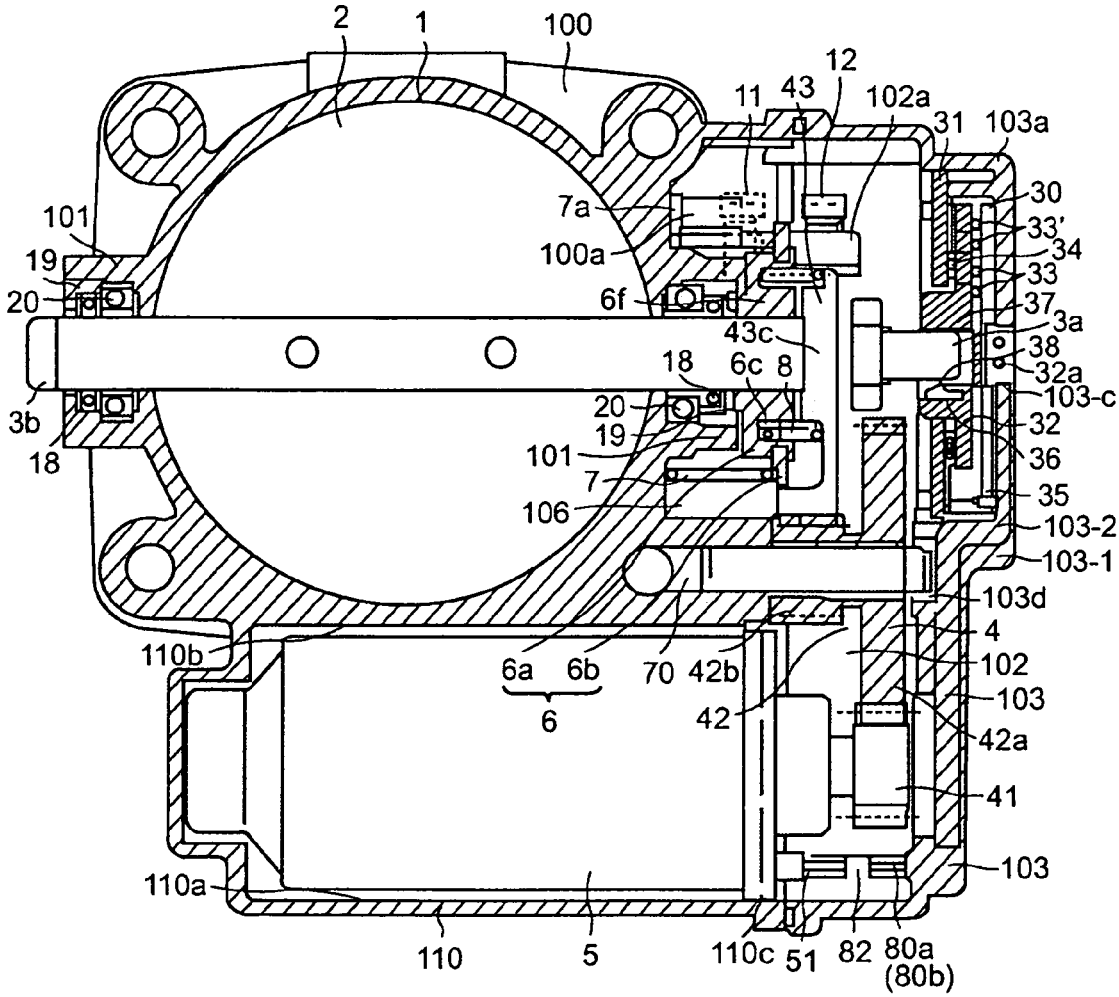
FIG. 22 is a detailed drawing of installation structure of a return spring and a default spring.
Figure 23:
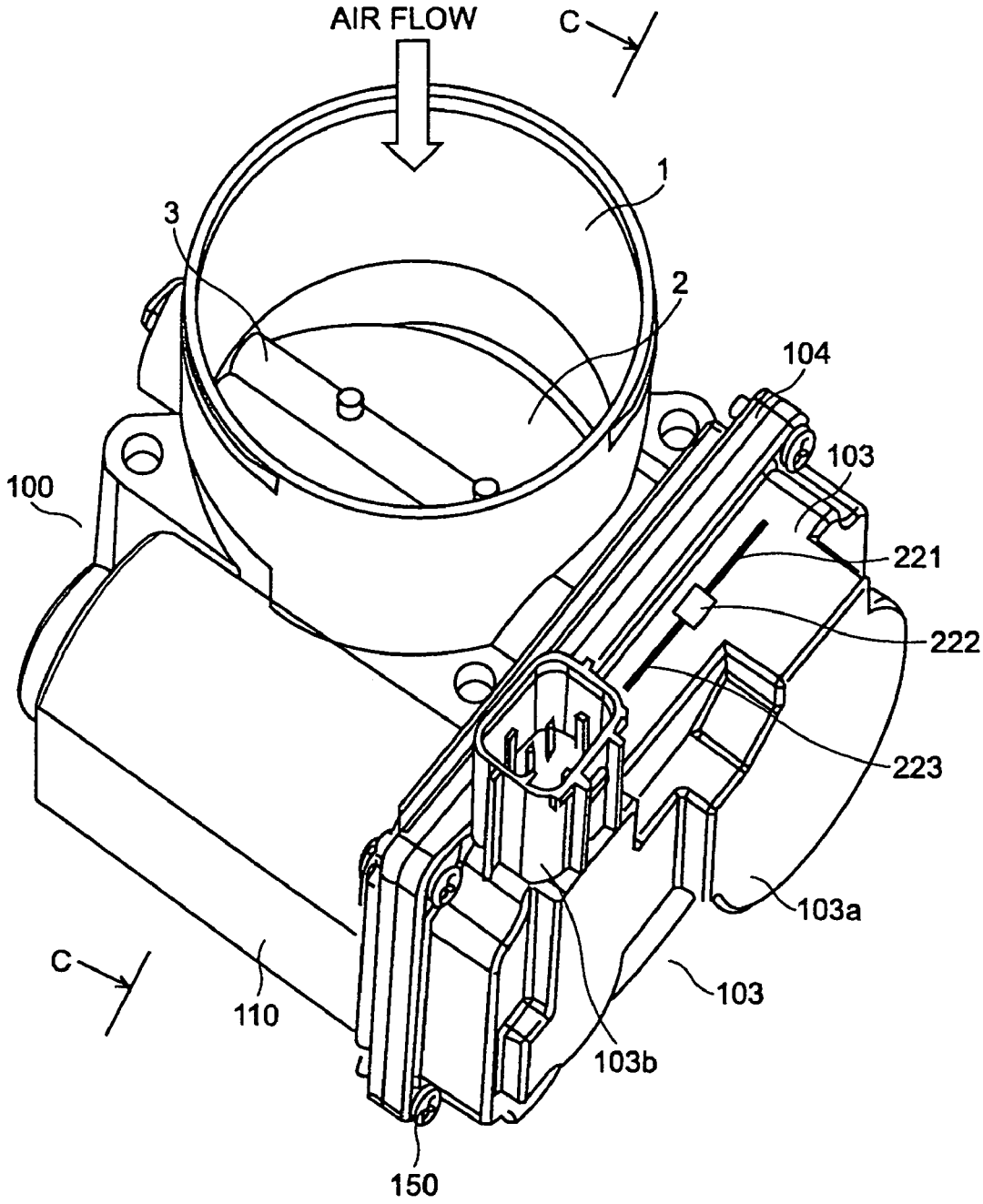
FIG. 23 is a view showing an electronically controlled throttle device.
Figure 24:
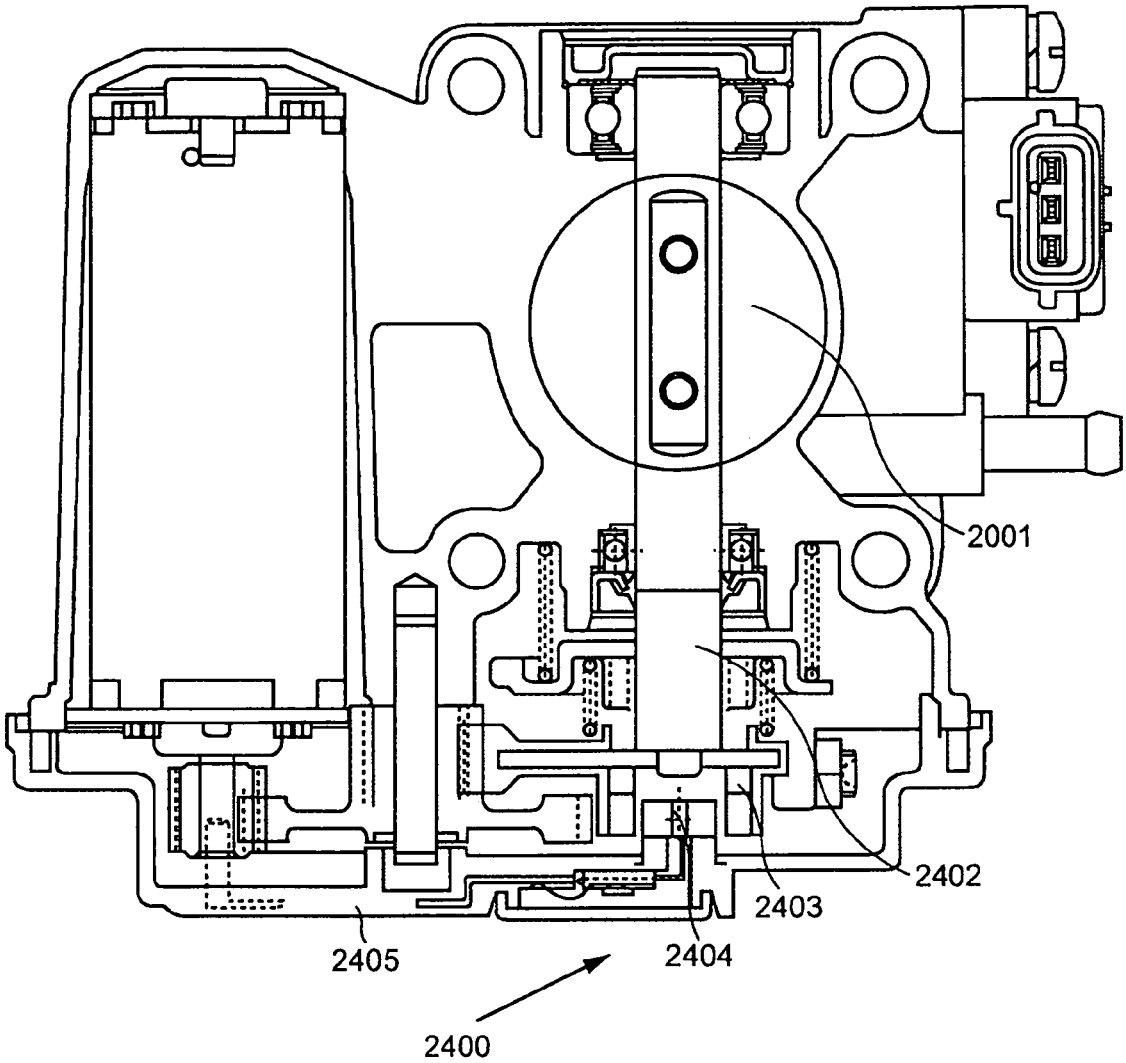
FIG. 24 is a configuration view of a throttle valve and a throttle sensor which detects the opening.
Figure 26:
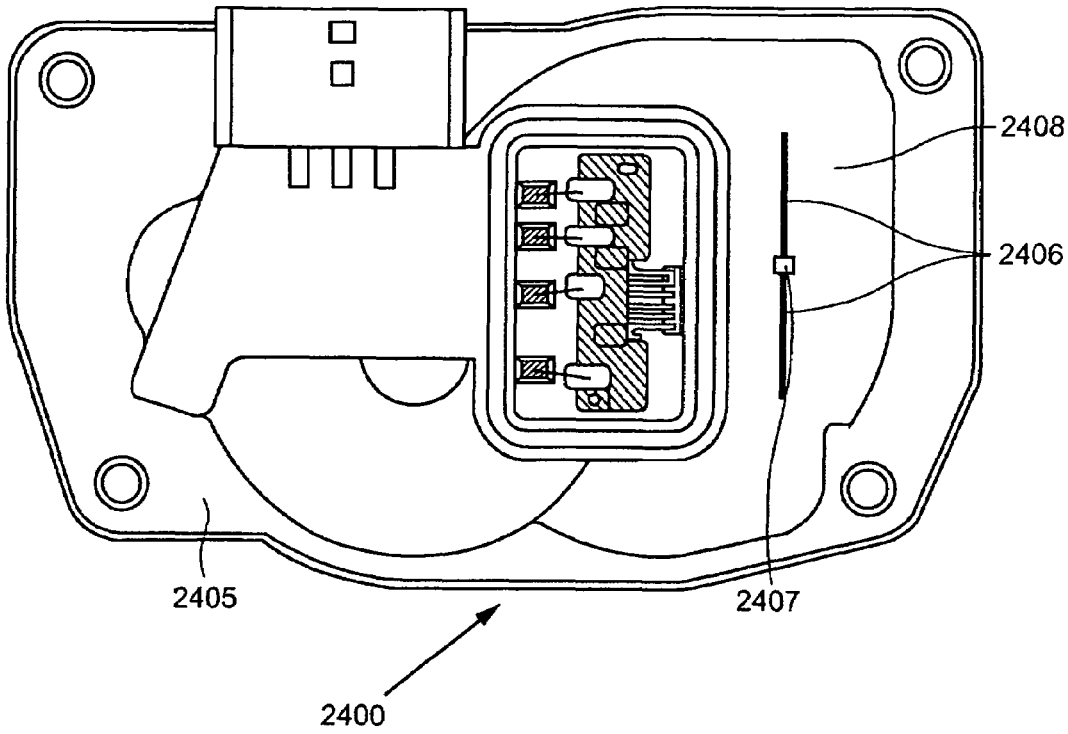
FIG. 26 is a view showing a throttle sensor which detects opening of throttle valve.

Although it is provided at one end on the opposite side of the teeth of throttle gear 43 to make spring engagement part 43*b* easy to see in FIG. 20, actually, it is provided to hide itself inside (Back side) of throttle gear 43. Further, although the engagement part at one end 7*b* of return spring 7 and the engagement part at one end 8*a* of default spring 8 are briefly shown in FIG. 20, the details of installation structures of these return spring 7 and default spring 8 are as shown in FIG. 22.

Close stopper 12 defines the mechanical close position of throttle valve 2. One end of the stopper engagement part (Throttle gear 43 doubles with it here) fixed to throttle axis 3 abuts stopper 12 when throttle valve 2 is rotated in the close direction until it reaches mechanical close position, and the close movement of throttle valve 2 is obstructed.

Stopper 11 (It is occasionally called the default stopper) for setting the default opening is used to make the opening of throttle valve 2 keep the fixed initial opening (Default opening) which is larger than mechanical close position and electrical close position (Minimum opening in the control) of throttle valve 2 when the engine key is turned off (When electric actuator 5 is turned off.).

Spring engagement part 61 provided to default lever 6 abuts default stopper 11 when throttle valve 2 is in default opening. As a result, it is inhibited to rotate in the direction (Close direction) where the opening of default lever 6 becomes small further. That is, the spring engagement part holds the function as a stopper abutting member concurrently. Close stopper 12 and default stoppers 11 is fixed by an adjusting screw provided to throttle body 100. Actually, they are arranged to be adjusted from the same direction in parallel or almost in parallel at the positions close to each other.

Because throttle gear 43 and default lever 6 are attracted to the rotation direction through spring 8 each other, they can engage and rotate together in the teeth of return spring 7 in the opening region larger than default opening (Refer to FIG. 21(*c*)). Because the movement of default lever 6 is inhibited by default stopper 11 in the opening region smaller than default opening, only throttle gear 43 can rotate together with throttle axis 3 in the teeth of the power of default spring 8 (Refer to FIG. 21(*a*)).

When the engine key is in an off-state, default lever 6 is pushed back to the position where it abuts default stopper 11 according to the power of return spring 7. Moreover, throttle gear 43 receives the power of return spring 7 through raised portion 62 of default lever 6, and therefore throttle valve 2 at the position corresponding to default opening (Refer to FIG. 21(*b*)). Under such a condition, throttle gear (Stopper engagement part) 43 and close stopper 12 maintain a fixed interval.

When throttle axis 3 is rotated from this state to an open direction through motor 5 and gear mechanism 4, default lever 6 rotates with throttle gear 43 through engaging portion 43*a* and raised portion 62. As a result, throttle valve 2 opens to the balance position of the rotating torque of throttle gear 43 and the power of return spring 7.

When the driving torque of motor 5 is weakened and throttle axis 3 is rotated in the close direction through motor 5 and gear mechanism 4 oppositely, default lever 6 (Raised portion 61) follows to the rotation of throttle gear 43 and throttle axis 3 until the lever abuts default stopper 11. When default lever 6 abuts default stopper 11, the rotation of default lever 6 to the close direction smaller than default opening is inhibited. Below default opening (For instance, from default opening to electrical close position in the control), only throttle gear 43 and throttle axis 3 release the engagement with default lever 6 when the power is given to throttle axis 3 by motor 5, and the lever can work in the teeth of the power of default spring 8. Only when the reference point in the control is recognized (For instance, when key of the engine is an on-state or an off-state, or when the device is adjusted), motor 5 is driven, and throttle gear 43 abuts mechanical close position of the throttle. In a usual electric control, throttle gear 43 does not abut close stopper 12.

The throttle position sensor which detects the rotating angle degree of throttle shaft 3 is installed in the throttle body while hiding the deceleration gear in the electronically controlled throttle device comprised like this.

As the throttle position sensor, a sliding resistance type sensor, a hall IC and a non-contact type sensor which uses a magnet is well-known.

Because the output of the sensor is used for the position control of the drive motor, it is necessary to recognize the position of the sensor and the throttle shaft accurately. However, because the individual size error and the allowable error of the sensor and the throttle body are different, the complicated adjustment process is necessary to decide the position which becomes a standard accurately.

As shown in FIG. 22, storage element 222 provided with antennae 221 and 223 are molded as one in gear cover 103 formed with the sensor installed in the main body of the throttle body when the resin is molded in this embodiment. Or, the storage element is fixed by painting a surface of the inside or the outside of the resin cover with a paint or is joined with an adhesive.

First of all, the output voltage value of the sensor is read in an initial state in which the motor is not turned on in the adjustment process. The code corresponding to this value is stored in storage element 222. Next, the throttle valve is put into the close state by energizing the motor, and the output voltage value of the sensor is read at this time. The code which corresponds to this value is stored in storage element 222. Next, the throttle valve is moved to the opened position by rotating the motor, and the output voltage value of the sensor is read at this time. The code which corresponds to this value is stored in storage element 222.

As mentioned above, the specific attestation code, the initial opening, the close position, and specific operating characteristics corresponding to the open position are stored in this throttle device.

When this throttle device is installed in the engine, the stored specific attestation code and specific operating characteristics are read by the wireless with the reader. The engine control unit recognizes the individuality of this throttle device. The information is used in various engine control such as the control of the opening signal control of the throttle valve, the control of the fuel injection amount, the control of the ignition time, and consequently, the control of the engine speed control.

Even if which throttle device is installed in which engine by composing like this in connection with throttle devices which the characteristics differ from each other, the specific operating characteristics of the throttle device can be controlled by the control unit of the engine in simple work. Therefore, after installing the throttle device, annoying match work becomes unnecessary.

Moreover, the condition of the aged deterioration of the throttle device can be understood, and the breakdown can be detected based on the operating characteristics stored when manufacturing.

In addition, the speed of response of the motor-driven (Electronically controlled) throttle device is decided depending on the control multiplier factor. This control multiplier factor is set to the value with large gain margin/phase margin so as not to occur the hunting even at the low temperature degree low tension.

As for the friction, the device difference (That is, a specific value of an individual device) is greatly different though the influence of the friction increases when becoming a low temperature degree and a low electric voltage. To absorb it, the operation must be slowed down based on the idea of the greatest common divisor.

In this embodiment, the solution means for the above-mentioned matter is also proposed. That is, the friction characteristic is individually measured in the production line, and the multiplier factor for which the gain margin/phase margin is considered is transmitted to the storage element of the ID tag by wireless and stored therein.

The controller for the throttle device or the controller of the engine control reads the friction characteristic (Multiplier by which gain margin/phase margin is considered) stored in this storage element by wireless, and sets the control multiplier factor.

A specific control multiplier factor to an individual throttle device can be given by composing like this. As a result, the hunting is decreased, and the stable high-speed operation is obtained even in the state of the low temperature and the low voltage.

The present invention is explained in detail as follows in case of the throttle valve sensor.

EMBODIMENT 9

Throttle sensor 2400 which detects the opening of throttle valve 2401 and the electrically controlled throttle are shown from FIG. 23 to FIG. 26. The change in the strength of the magnetic field from rotating permanent magnet 2403 installed in throttle shaft 2402 is detected with hall element 2404. As a result, the relative angle position of the hall element to the permanent magnet is detected.

IC tag 2408 which comprises antenna 2406 and storage element 2407 is molded as one with resin cover 2405 of sensor 2400 when the resin is molded in this embodiment. Or, the IC tag is fixed by painting the resin cover with a paint or is joined with an adhesive.

An output of the hall element, an initial position of permanent magnet 2403 (Thus, a position of throttle shaft 2402), that is, zero point information, an origin and a specific recognition code of hall element 2404, basic operating characteristics of the hall element and temperature characteristics are transmitted to the IC tag by radio signal, and stored in the storage element of the IC tag together.

Thus, hall IC part of the sensor provided with the storage part to write information by cable as the conventional hall IC can be made of only the hall element. Therefore, the manufacturing cost is decreased.

Moreover, the stock control and the determination of the combination of a throttle device and an engine becomes easy because the information on the zero point and the temperature characteristics can be written or read by wireless, and the information from a lot of sensors can be recognized at the same time.

The present invention is explained in detail as follows in case of a resolver for the rotational displacement detection of a motor.

EMBODIMENT 10

Figure 27:
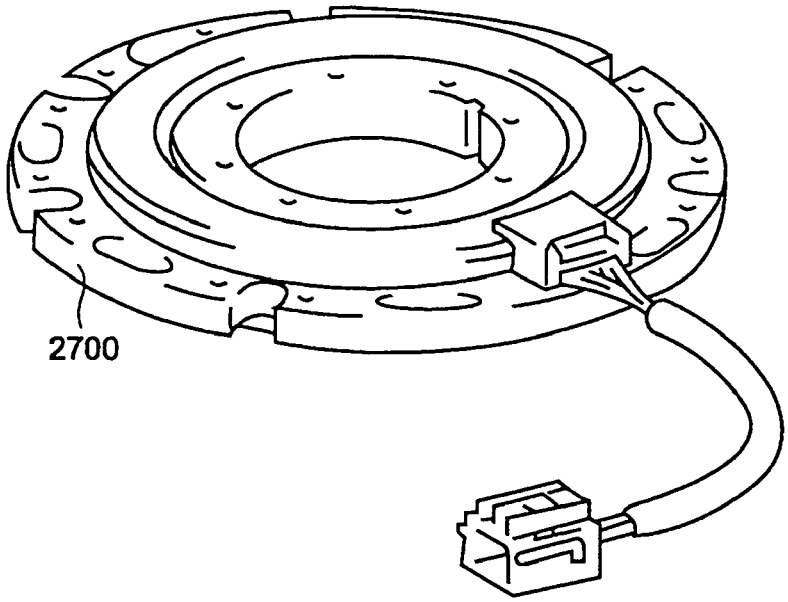
FIG. 27 is a view showing a rotation sensor (Resolver) which detects rotation of the motor used for electric automobiles.
Figure 28:
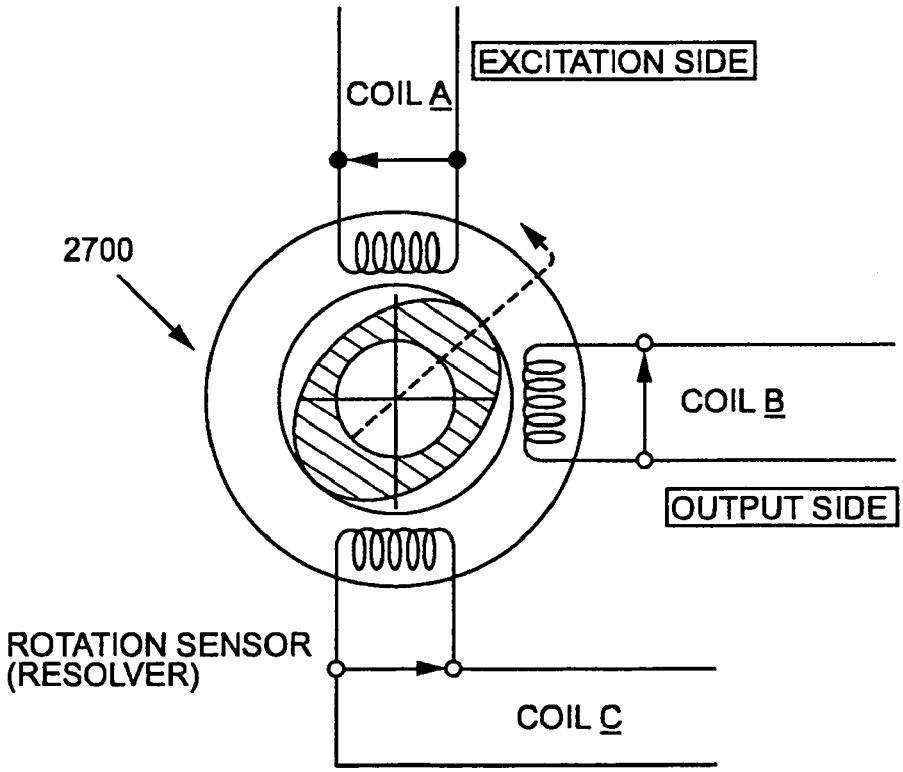
FIG. 28 is an explanatory drawing of the resolver.

FIG. 27 shows a rotation sensor (Resolver) which detects the rotation of the motor such as for electric automobiles. Three coils A, B, and C are built in stator 2801 of a sensor of the resolver as shown in FIG. 28. Output coils B and C are arranged apart electrically at 90° with each other. The gap length between stator 2801 and rotor 2802 changes if rotor 2802 rotates because rotor 2802 is oval as shown in the figure. Therefore, if the alternating current is thrown into coil A, the output according to the position of sensor rotor 2802 is generated in coils B and C. The absolute position is detected from the difference of these outputs.

And, to function as a rotating speed sensor, the amount of the position change within the fixed time is operated by a computer.

Now, it is required that the detection accuracy of the resolver rotating angle degree be highly accurate in the motor control by the resolver.

Figure 29:
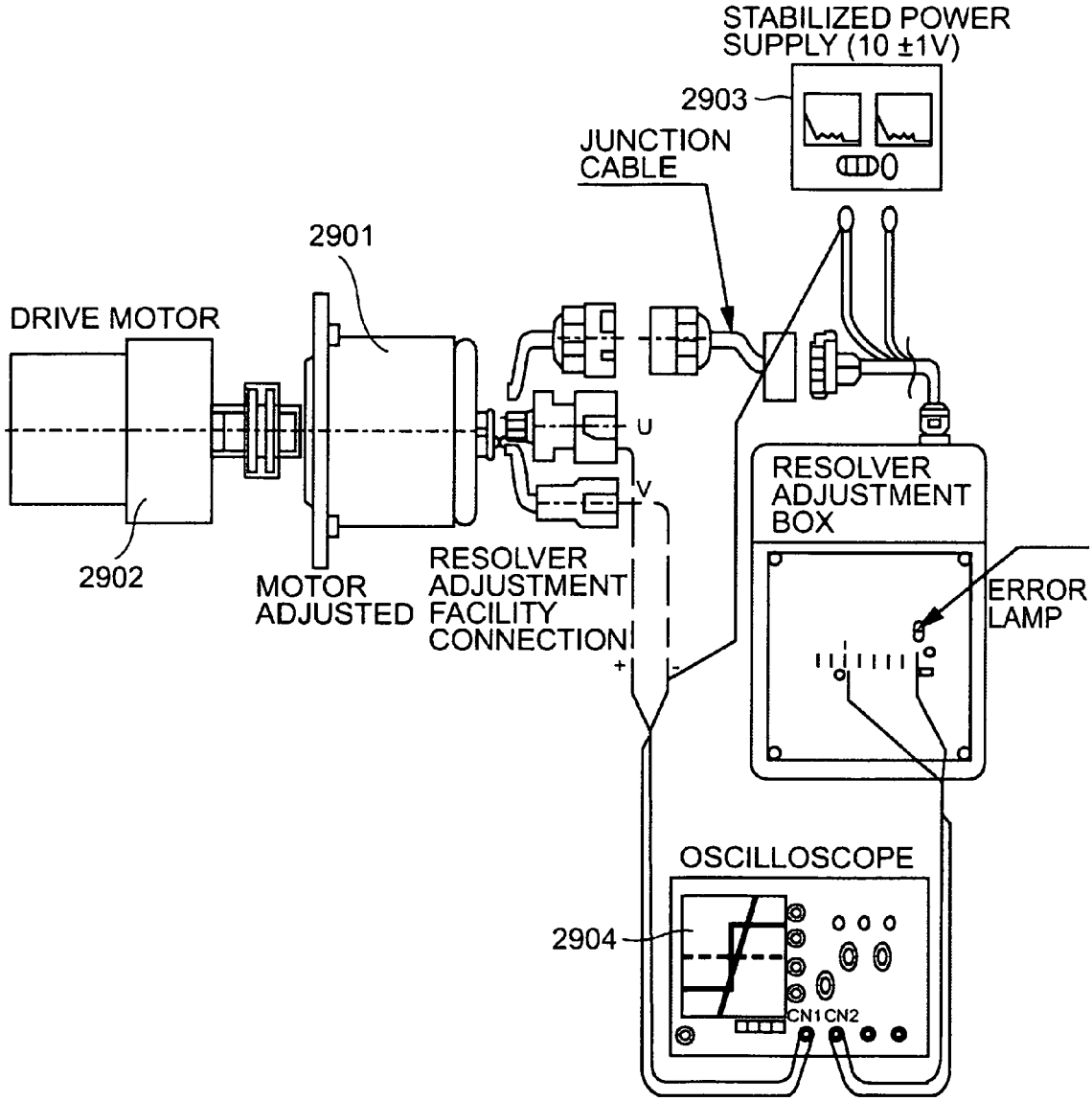
FIG. 29 is a view showing a control system of the motor by the resolver.

At present, the adjustment of the phase is performed as shown in FIG. 29. Motor 2901 to be adjusted is connected with driving motor 2902. Each of coils U, V and W is connected with stabilizing supply 2903 and oscilloscope 2904 as shown in the figure. The screw provided in the adjustment hole of an oblong in the installation part of the sensor and the motor is loosened as the worker looks the waveforms displayed on an oscilloscope the adjustment of the phase is performed by rotating the resolver in a clockwise or a counterclockwise direction. Therefore, a lot of time is necessary for the adjustment.

Figure 30:
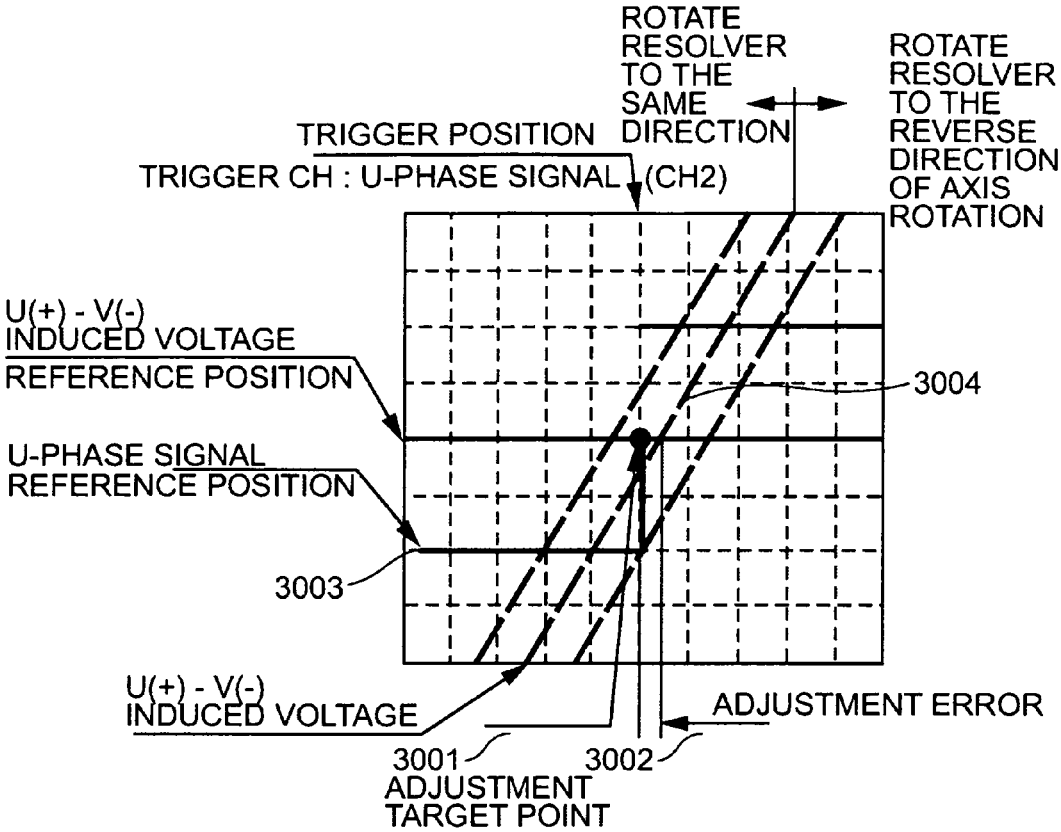
FIG. 30 is a view explaining the motor control by the resolver.

In this embodiment, shift 3002 of U-phase (V-phase and W-phase) voltage (3004), triger signal 3003 and reference position 3001 are measured for instance as shown in FIG. 30 based on the waveforms displayed on the oscilloscope in the adjustment equipment of FIG. 29. The measured value is stored in the memory of the IC tag installed on the motor or the rotation resolver by the radio communication along with each attestation code of the resolvers of the motor.

The controller of the motor reads the attestation code of each of the motor and the resolver installed in the electric automobile and shift 3002 of each of the U-phase, V-phase and W-phase voltages as operating characteristics from the IC tag installed in the motor or the rotation resolver by wireless. They are transmitted to the microcomputer of the controller, and the motor is controlled based on each shift 3002.

As a result, the work to adjust the position of the resolver becomes unnecessary.

The present invention is explained in detail as follows in case of a high-pressure fuel pump.

EMBODIMENT 11

To control the discharge capacity according to the engine speed, the high-pressure gasoline pump which supplies the fuel to the injector of an internal combustion engine of the cylinder fuel injection type includes the variable capacity control valve. As a control of the variable capacity control valve, there are used a method of controlling the remaining amount of the fuel which remains in the compression chamber by the variable control of closing timing of the intake valve, and a overflow control system which control the open/close timing of the by-pass passage to exhaust from the compression chamber to the air intake passage. In such a method, the delay time from the application of the electric signal to the reach of the valve to the target position exists.

Individual delay time is transmitted to the IC tag installed in the resin connector of a high-pressure pump by wireless together with the attestation code of the high-pressure pump, and is stored in a memory in this embodiment.

After a high-pressure pump is installed in the engine, the delay time of individual high-pressure pump can be read by wireless by composing like this. Therefore, the controller for an engine control can control variable capacity based on the specific operating characteristics (Delay time) of the high-pressure pump installed in the vehicle body. Therefore, the variable capacity control of the high-pressure fuel can be performed with a high degree of accuracy.

The maximum flow rate of a single cylinder pump varies according to the delay time of the flow control solenoid. It is required to design so that enough flow rate can be obtained by taking the above-mentioned difference (About 6%) into consideration for the demand flow rate of the engine in the design of the single cylinder pump. Therefore, the large flow rate pump more than being needed is designed in a lot of engines.

Then, the delay time of the flow control solenoid is recorded in the storage element of the ID tag. Or, the map of the discharge flow rate to the control timing of the valve is recorded therein. The ECU (Engine control unit) determines the delay time or control timing based on the above-mentioned information. The flow rate difference caused by the difference of the flow control solenoid can be decreased by composing like this. As a result, the pump can be miniaturized, and the flow rate can be decreased (About 6%).

The present invention is explained in case of the variable resistor type throttle position sensor used for a motor-driven throttle device shown in FIG. 22.

EMBODIMENT 12

Figure 31:
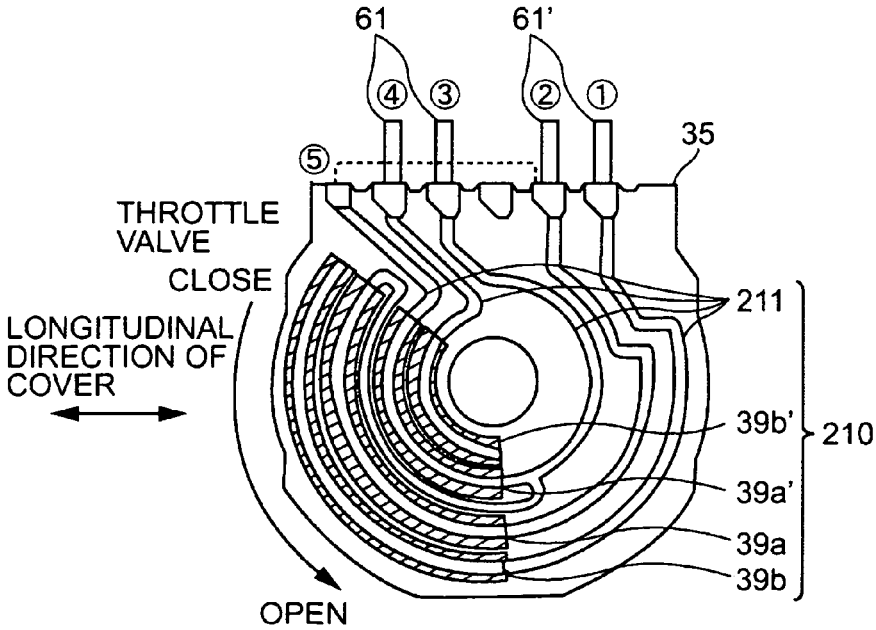
FIG. 31 is a detailed drawing of a substrate of a sensor.

FIG. 31 shows substrate 39 of a sensor in detail. Resistor 210 in which the resistor like the film is printed, wiring pattern 211 for wiring and terminals 61 and 61' are provided on substrate 35. Resistor 210 has a circular arc shape. Resistor 210 comprises resistance patterns 39*a*, 39*a*' whose resistance changes in a rotation direction and collecting patterns 39*b* and 39*b*' whose resistance does not change in the rotation direction. The resistance pattern and the collecting pattern are arranged in the concentric circular. Resistance patterns 39*a* and 39*a*' comprise the resistor in which the carbon and the resin are mixed. As for collecting pattern 39*b*, 39*b*' and wiring pattern 211, the layer of the resistor is formed in the pattern of metal (Conductor).

when the voltage is applied on both ends of the resistance pattern, the amount of the voltage drop at the position of the brush is in proportion to the distance from the edge at high voltage, and becomes the source of the output of the throttle sensor. The portion where the brush does not slide becomes large when the central angle of a circular arc of resistance pattern is large, and the position resolution decreases. Therefore, it is preferable to shorten the resistance pattern within the range where tracks of the brush do not deviate from the resistance pattern. For instance, when the range of sliding of the brush is set to 90°, the angle of the circular arc of the resistance pattern is preferable to be about 130°.

In the collecting pattern used as a pair with the resistance pattern, the change in resistance depending on the position is as small as can be disregard. The collecting pattern plays a roll in transmitting an output signal of the resistance pattern outside. The output (Voltage) from the resistance pattern to the collecting pattern is transmitted by brushes 33 and 33'.

Brush 33 is forked. One end of the brush is in contact with collecting pattern (39*b*) and the other is in contact with resistance pattern (39*a*). Another brush 33' is in contact with collecting pattern 39*b*' and resistance pattern 39*a*'. The width of the resistance pattern is widen more than the width of sliding of the brush as a trim margin to prevent brush 33 and 33' from dropping out of the resistance pattern and make the output the desired characteristics (Throttle position-voltage is a straight line in the embodiment).

To obtain-two channels (Output), the throttle sensor of this embodiment has the resistance pattern and the collecting pattern. One channel is composed of the combination of collecting pattern 39*b* of the most outer and resistance pattern 39*a* which is an inside line from it by one line, and the other channel is composed of the combination of collecting pattern 39*b*' of the most inner and resistance patterns 39*a*' which is outside of the collecting pattern.

Figure 32:
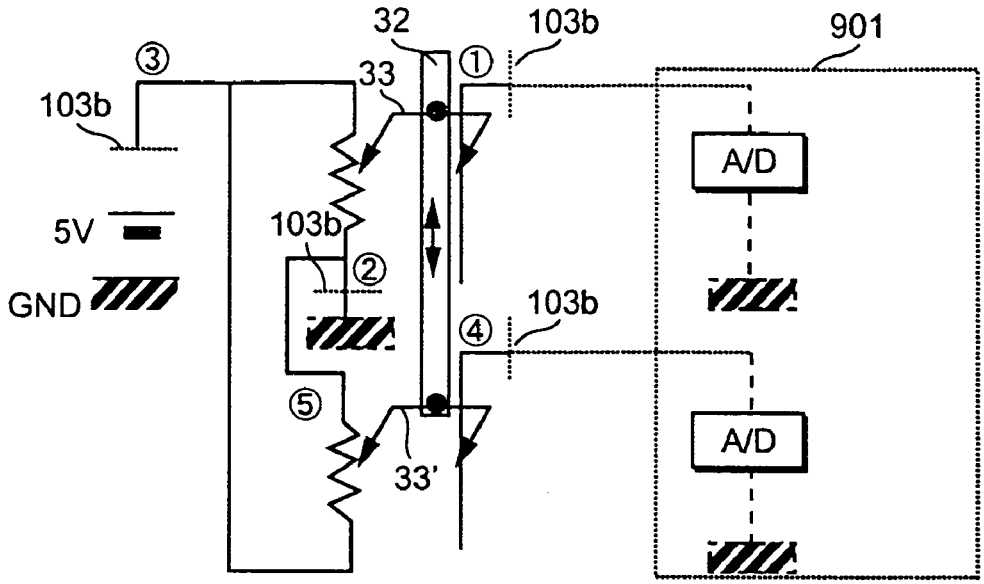
FIG. 32 is a circuit diagram of the throttle sensor.

FIG. 32 shows a circuit diagram of the throttle sensor. Each sign of [1]-[5] in the circuit diagram corresponds to the position of each sign of FIG. 31. The dotted line shows the outside of connector part 103*b*. Outputs of the throttle sensor are output from [1] and [4], and sent to analogue to digital (A/D) converter of control circuit 221 for an external electronically controlled throttle to control the position of the throttle valve. The throttle sensor according to this embodiment has the characteristic in which the absolute value of the inclination of two outputs (Ratio of the change in the throttle valve position and the change in the output) is the same, and the sign of the inclination is reverse. Because the sum of two outputs becomes constant by composing like this, the failure can be easily diagnosed without carrying out the complicated operation in the control circuit even if either output becomes abnormal.

Because this sensor has two channels (Output), Originally, it is necessary to connect the power supply, the ground and the output to the outside by using three wirings for each channel, that is, six wirings for two channels. On the other hand, the cost and the wiring space can be reduced and the reliability of the wiring can be improved if the number of wirings is decreased. Further, because the number of pins can be saved, connector part 103*b* can be miniaturized. In this embodiment, it is advantageous in manufacturing because the wiring is built into cover. In addition, sharing the ground of two channels ((2) and (5)) and sharing power supply ((3)) are aimed at to simplify wiring, and wiring from the substrate to the outside is decreased to four.

Even if the same member is used for throttle body 100 and cover 103, the amount of the expansion when the temperature changes is different because of the difference of the shape. Especially, the difference is remarkably when cover 103 is made of the resin and throttle body 100 is made of the aluminum alloy like this embodiment. Because the side of the cover (The side parallel to the axis of the throttle valve) bends by the thermal expansion (Or the shrinkage) even if the cover is fixed with the screw when cover 103 is not plane, and a fixed side of substrate 35, the cover, and the clamp face of screw 150 which fixes the throttle body are different like this embodiment, reducing the amount of the movement of substrate 35 becomes difficult more and more.

Figure 33:
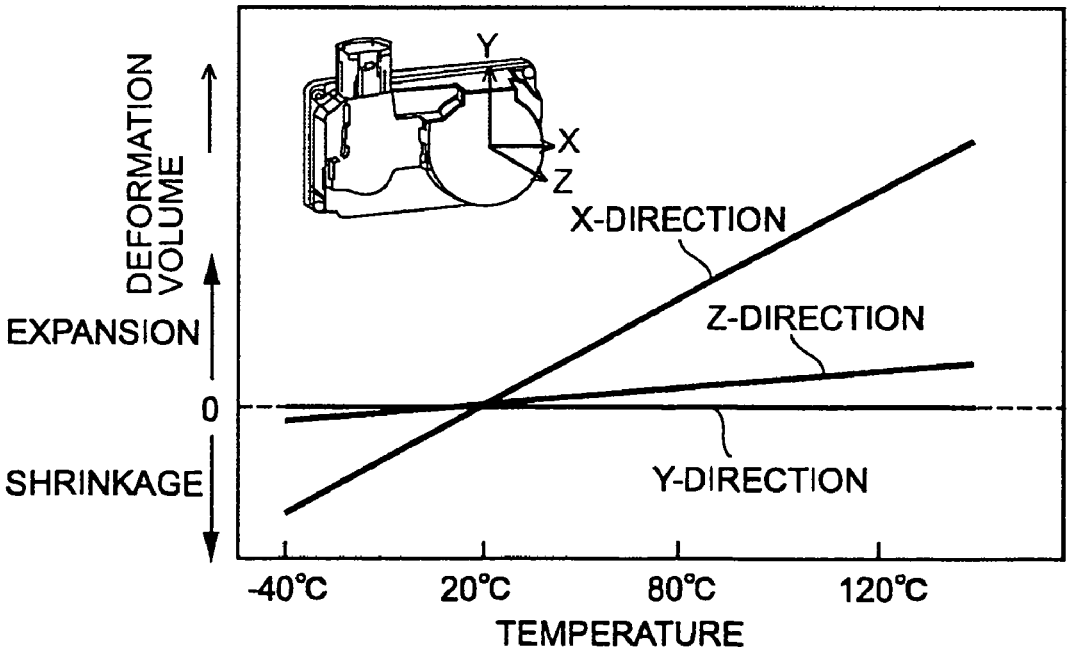
FIG. 33 is a view showing the amount of movement of the substrate to a throttle body by thermal expansion of a cover.

FIG. 33 shows an amount of the movement of substrate 35 to throttle body 100, which is caused by the thermal expansion of cover 103. The substrate moves when the cover expands (Or shrinks) because substrate 35 is not located at the center of gravity of the cover. For instance, if the temperature rises, the amount of the movement of substrate 35 increases most in the longer direction of cover 103(X direction in FIG. 33). The longer direction here means a direction where the amount of the thermal expansion of the cover is the largest. In other words, the reason is that the member which expands by heat is in excess in the longer direction when assuming that the expansion of the member is isotropic. The reason why substrate 35 moves in the longer direction is for the position of substrate 102 to shift from the center of gravity more than other directions of cover 103. The movement is extremely little for the shorter direction (Y direction in FIG. 33) because substrate 102 is arranged almost at the center (Near the center of gravity of the shorter direction) of the shorter direction. The amount of the movement to the direction of depth (Z direction in FIG. 33) is less than the X direction because the distance from the X direction to the Z direction is short, and the member which expands by heat is few.

Here, it is possible to usually think that the longer direction shows the direction where the size of the cover is large.

Moreover, the longer direction here is almost a direction perpendicular to the intake air passage where throttle valve 2 is arranged. When a rotary actuator (Motor) is used, it is effective to arrange the output shaft of actuator at a position which is parallel to the throttle valve axis and near the throttle valve axis to transfer the torque of actuator to throttle valve axis 3 effectively. Therefore, the cover by which the drive mechanism to transfer the power of actuator is covered becomes long almost at right angles to the intake air passage.

Moreover, the longer direction here also means a direction to which the resistance pattern of the throttle sensor and the brush relatively move. Normally, the movement of the resistance pattern is caused by the thermal expansion of the cover. However, the brush connected with the throttle valve axis moves with respect to the resistance pattern by the amount of play of the bearing and the throttle valve axis regardless of the direction of the thermal expansion of the cover when the clearance between the throttle valve axis and bearings which support the throttle valve axis is large. Especially, it moves to the direction parallel to the intake air passage (Direction of the flow) by the fluid power which acts on throttle valve 2 occasionally. The principle where the error occurs is the same as the case in the thermal expansion of the cover. Therefore, the present invention can decrease the error in such a case. When the movement by the play and that by the thermal expansion is on the same level, the direction of the movement caused by both is assumed to be the longer direction.

Figure 34:
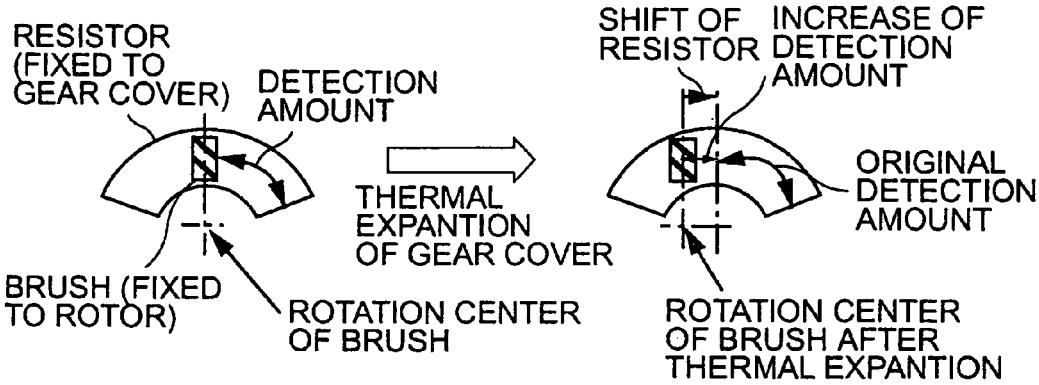
FIG. 34 is a view explaining the generation principle of an error.
Figure 36:
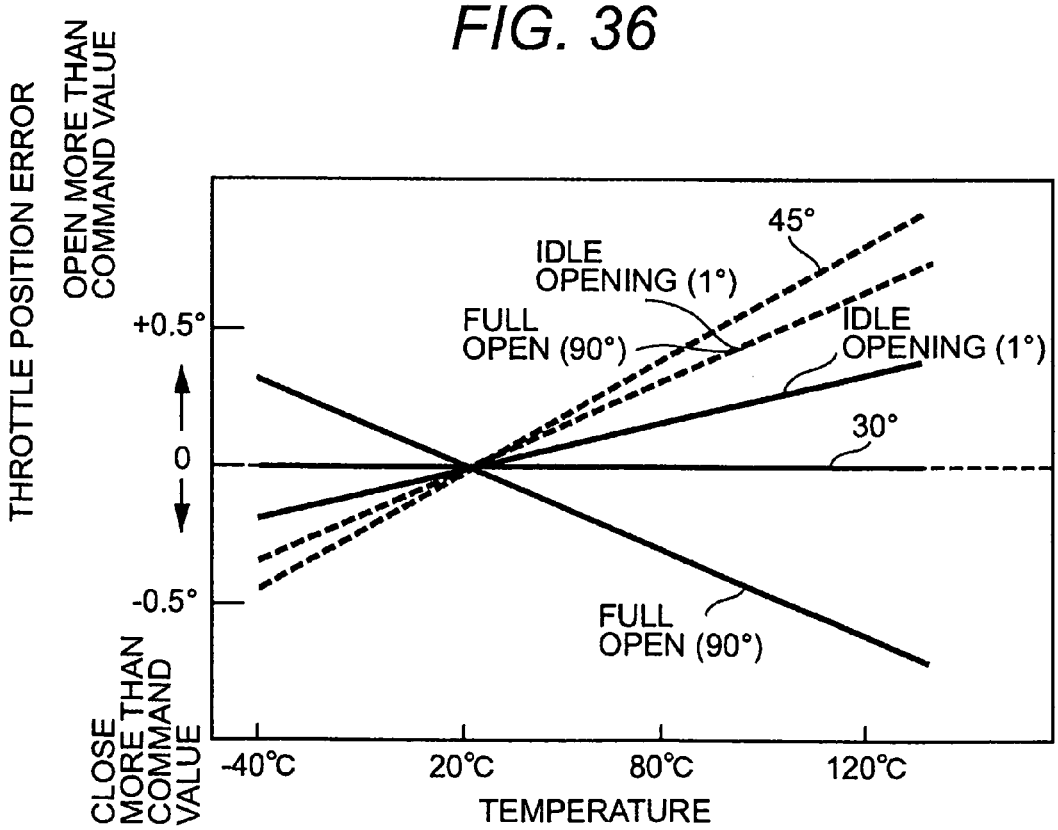
FIG. 36 is a view showing relationship between the throttle position and the temperature.

The generation principle of the error is explained by using FIG. 34. An initial position of the brush and the substrate is shown in FIG. 34(*a*). The brush is located at the center of a circular arc resistance pattern in the figure, and the center of radius of the circular arc of resistance pattern radius and the center of rotation of the brush (Rotation center of the throttle valve axis connected with the brush) is corresponding. FIG. 34(*b*) shows the case where the brush does not rotate and the relative position of the substrate and the brush changes. The distance from one end of the resistor changes though the brush does not rotate. As a result, the output changes as if the throttle valve axis rotates. With regard to an actual electronically controlled throttle, the output of the throttle sensor might change even if the position of the throttle valve does not change when the position of substrate 35 moves with respect to throttle body 100, and the shift is caused between brushes 33, 33' and resistance pattern 39*a*, 39*a*'.

The error which originates from the change in the output, that is, from the temperature change increases as the distance of the shift becomes longer. It may be possible to reduce the shift by bringing coefficients of linear expansion of the members into the approximate value to decrease the error. However, even if the coefficient of linear expansion is brought close, it is impossible to eliminate the shift completely because of the difference of shape and the temperature distribution etc.

To control precisely an intake airflow rate suitable for the operation of the internal combustion engine, an electronically controlled throttle is controlled while detecting the throttle valve position. Therefore, when the error is caused in the throttle sensor which detects the position of the throttle, an accurate airflow rate cannot be controlled. When the error of the throttle sensor is large, the idling speed for which the intake airflow rate must be controlled minutely might not be controlled accurately. In addition, the engine stalls because the control to close throttle valve unnecessarily is carried out, or oppositely the unintended increase of the engine speed occurs because the valve is opened too much. Moreover, although it needs not so much accuracy as that in the neighborhood of the idling speed, there is a possibility to shorten the life time of the mechanism because the valve tries to move on from the mechanical limit position when the error is large in the vicinity of the opened position of the throttle valve. The error of the throttle sensor is undesirable with regard to not only the control of the intake airflow rate but also the endurance of electronically controlled throttle. The following is required for the output of the throttle sensor.

[1] To reduce the error as a whole.

[2] Especially, to reduce an error near the close position (Idling area) where a precise positioning is demanded.

[3] To reduce an error in the vicinity of open position.

Figure 35:
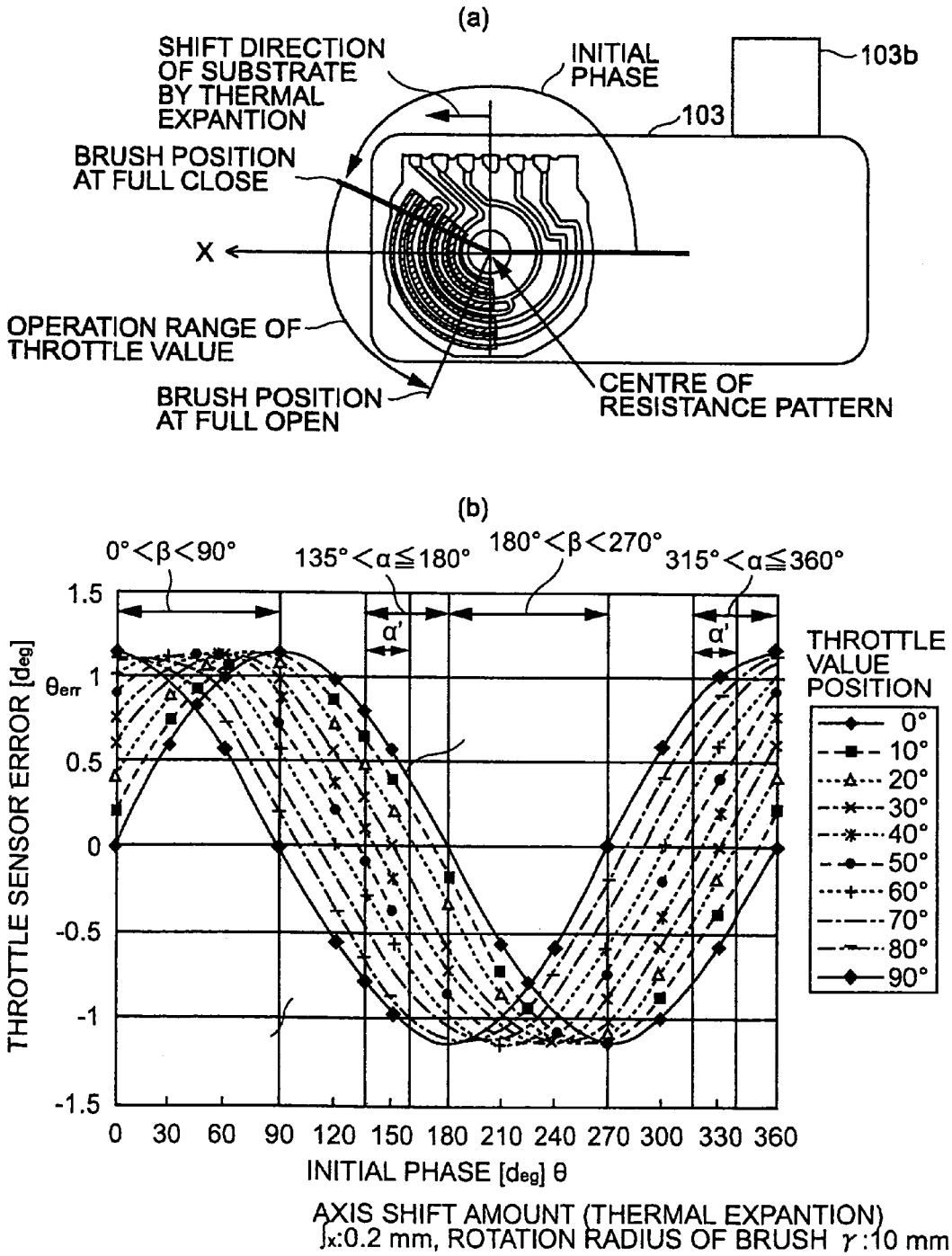
FIG. 35 is a view showing relationship between the initial phase and the error.

By the way, the error of the throttle sensor changes in the direction of the movement of the brush to the resistance pattern even if the size of the shift is constant. To make easily to explain, the angle around an anti-clock from the longer direction (X axis) of the cover to the brush position of the closed throttle valve in the surroundings of the center of a circular arc of the resistance pattern will be called a initial phase. FIG. 35(*a*) shows the above state. The relationship between the initial phase and the error when the amount of the shift is assumed to be constant is shown in FIG. 35(*b*). FIG. 35(*b*) shows one example of an amount of the error in which the shift of the longer direction (X axis) is 0.02 mm and the radius of a circular arc of the resistance patterns is 10 mm. It is usually almost 90° though the operating angle of the throttle valve can be arbitrarily set. The throttle valve in this embodiment has the range of operation of about 90°. The following fact is seen from FIG. 35. When the direction (X axis) of the shift and the position of the brush is corresponding (Throttle valve position+initial phase=180° or 360°), the error is minimized. The reason for this is that the output change (Error) becomes small because the inclination of the voltage is minute in a direction of the width of the resistance pattern when the brush moves to the direction of the width of the resistor. On the other hand, when the direction of the shift and the position of the brush becomes vertical (Throttle valve position+initial phase=90° or 270°), the error becomes maximum. The reason for this is that the great output change occurs and the error grows because the inclination of the voltage becomes large along the circular arc of the resistance pattern when the brush moves along the circular arc. From the above-mentioned point of view, it is understood that the error is decreased only by matching the direction where the brush is moved to the direction where the shift is generated at least one point within the range of operation of the throttle valve.

In order to perform the above-mentioned operation, the initial phase should be decided so that the brush may pass through the longer direction (X axis in FIG. 35(*a*)) in the range of operation of the throttle valve. The resistance pattern also should be formed so as to include the longer direction in conformity with the sliding range of the brush. Now, referring to FIG. 35 in which the range of operation of the throttle valve is assumed to be 90°, It is understood from FIG. 35(*b*) that such a initial phase is a range of 90°-180° and 270°-360° (0°). For instance, when the initial phase is set to 120°, only the errors of (+) 1° at the close position, 0° at 60° and (−) 0.6° at the open position are caused. There is a throttle position where the error due to the thermal expansion becomes 0 if the initial phase is set like this. It is, therefore, possible to make up a throttle sensor in which there are few errors even if the temperature changes over the range of operation. On the other hand, when the initial phase outside the range, for instance, the initial phase is 30°, at the close position, it is (+) 0.6° which is advantageous, but otherwise the error becomes as many as 1.1° at maximum.

It is preferable that the error for the throttle sensor is few at the throttle position used at idling. For this purpose, the brush should pass through the axis line which connects between the longer direction of the cover and the center of a circular arc of the resistance pattern within the region less than half of the range of operation of the brush. The throttle position where the error becomes 0 approaches the low opening side by composing so, and the error decreases at the low opening side rather than the high opening side. That is, it is preferable that the circular arc of the resistance pattern is asymmetric with respect to the longer direction of the cover, and the close position is provided close to said axis line. To achieve this, the initial phase is set to the range of 135° or more and 180° or less, or 225° or more and 360° or less as shown in FIG. 35(*b*) as sign $\alpha$, when the range of operation of the throttle is assumed to be 90°. By the configuration where the brush passes the axis line at half of the range of operation of the throttle valve, in other words, when tracks of the brush are symmetry with respect to said axis line (In case that the initial phase is set to 135° or 315° in the embodiment), such a preferable characteristic of the error is not obtained.

More preferably, the error for the throttle sensor is few at the throttle position used at idling, and at the same time, the error is few also at the open position. The error at open position increases when the error at idling is decreased the brush should pass through the axis line which connects between the longer direction of the cover and the center of a circular arc of the resistance pattern within the region less than ¼ to ½ of the range of operation of the brush in view of the balance of both. Thus, the error can be reduced even in the vicinity of the idling position and the vicinity of the open position. In FIG. 35(*b*), such a range becomes the range of the initial phase 135° or more and 157.5° or less as shown by sign $\alpha'$.

The initial phase of the brush was set to 150° in this embodiment for the above-mentioned reason, and resistance pattern 210 like FIG. 31 is formed so as to fit it.

Although the contact type throttle sensor which especially has a plane resistor is described in the above-mentioned embodiment, a similar effect is achieved by arranging the direction of the low sensitivity to the movement of the throttle valve axis of the throttle sensor in the direction perpendicular to the throttle valve axis of the throttle sensor in the longer direction of the cover even in another type throttle sensor.

Resistance patterns 39*a* and 39*a*' are adjacent to each other in the embodiment. The reason for this is that there is an effect to bring the output close according to bringing the radius of the resistance pattern close. The following relation is satisfied between an amount of the shift of the brush position on the resistance pattern and an amount of the error. The error is a function of the radius of a circular arc of the resistance pattern and an amount of the shift (Displacement), and if the radius of a circular arc of resistance pattern is close, the amount of the error approaches. Therefore, the difference between two outputs becomes small, and the position can be detected with a higher degree of accuracy.

The controller reads the outputs of TPS1 and TPS2, and compares the deviation between them with the threshold value set beforehand for fail safe. The failure diagnosis of TPS is performed by judging the breakdown if the deviation is larger than the threshold value.

However, the resistances of TPS1 and TPS2 are adjusted by humans so as to match each other in order to reduce the output deviation between TPS1 and TPS2. Therefore, it takes a lot of labors to adjust it. Moreover, because the deviation cannot be completely eliminated by such an adjustment, the threshold which corresponds to the deviation is set. In this embodiment, the characteristic of each of TPS1 and TPS2 is stored in a storage element of the ID tag with the ID code of the sensor in the form of the coefficient of the polynomial expression. It is preferable to memorize the deviation of TPS2 to TPS1 as a coefficient of the polynomial expression to reduce the memory capacity.

The adjustment of the equipment by human strength becomes unnecessary by memorizing the deviation between TPS1 and TPS2 beforehand according to the embodiment made up like this. Therefore, because mass production not only improves but also there is no necessity which relies on the accuracy of the adjustment, the threshold value can be set small, and the accuracy of the failure diagnosis can be improved.

Moreover, the output change of the sensor which originates in the temperature change can be measured beforehand in the production line. The value is transmitted to a storage element of the ID tag installed in the sensor cover as specific operating characteristics by the wireless, and stored with the ID code of the sensor.

In addition, the change in the output of the sensor due to the change in the temperature of the cover can be suppressed by providing the temperature sensor which detects the temperature of the sensor assembly, and correcting the change in the output of the sensor output due to the change in the temperature change of the cover based on an output of this temperature sensor. In this case, there is an effect that the installation positions of the cover and the sensor can be freely set.

EMBODIMENT 13

Figure 37:
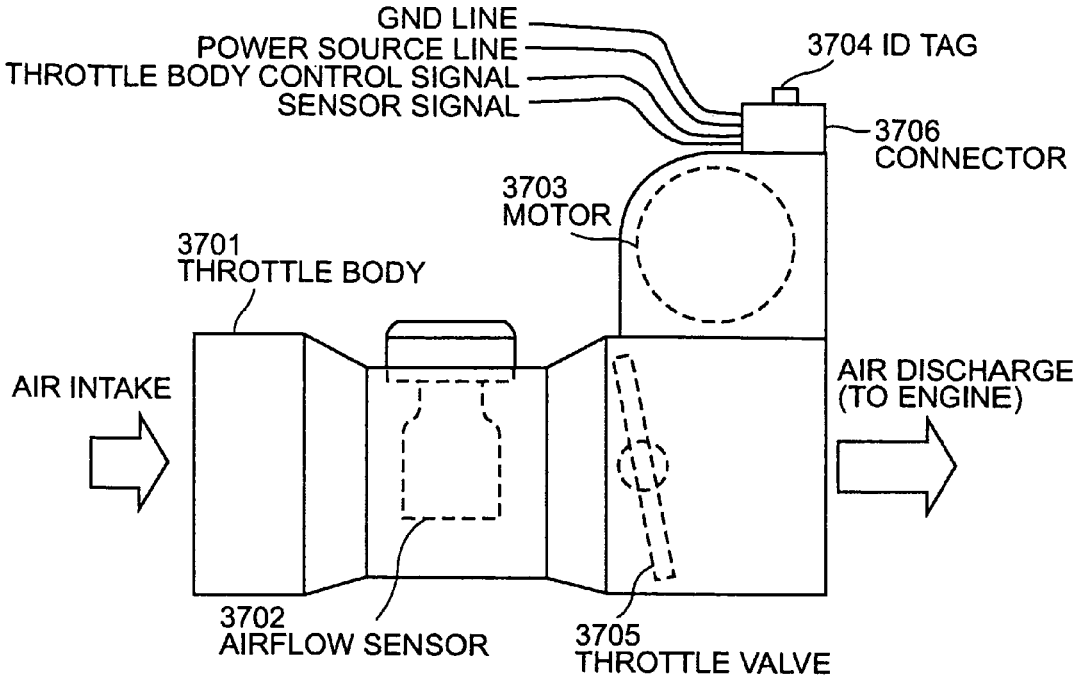
FIG. 37 is a view showing the structure of the throttle body with the built-in airflow sensor.

The application in which data on plural kinds of parts is stored in the limited number of storage elements of the ID tag is described. FIG. 37 shows a throttle body with a built-in airflow sensor. A basic structure comprises throttle body 3701 which is a base of parts, airflow sensor 3702 inserted in a pipe into which the air flows, throttle valve 3705 which adjusts an amount of the airflow, motor 3703 which provides the driving force to the throttle valve, connector 3706 by which a throttle body control signal line, sensor signal line, a power wire, and a GND line are connected, and, ID tag 3704 which records the specific information on the throttle body and the airflow sensor. It is not necessary to arrange the throttle body with a built-in airflow sensor as a different body in the air inflow pipe as conventional ways, and it is possible to arrange intensively in one place. Moreover, there is a merit that the power wire, the GND line, the sensor signal line, and the throttle body control signal line are consolidated in one connector.

The following information is included as the specific information. The specific attestation code for the throttle body, the initial opening, the close opening, and the opening fully opened, the initial position of permanent magnet 2403 explained in embodiment 8, in a word, the information on zero point, the information on the origin and the specific recognition code of hall element 2404, and basic operating characteristics of hall element, etc. in addition, the characteristics of the airflow sensor in embodiment 7 (The specific ID code, and the results of measurement of the sensor and an airflow amount characteristic).

After assembling the airflow sensor and the throttle body, these specific information are individually measured, and stored in one ID tag. It is possible to individually measure the characteristic of each of the parts before installing the airflow sensor. However, it is likely to differ from the condition when individually measured because the shape of the inside of the pipe changes after the installation of the airflow sensor. If possible, it is preferable to measure together the characteristic value after assembling the airflow sensor and the throttle body.

Although it is possible to prepare the ID tag as individually as embodiments 7, 8, and 9, and write individually, it is thought that recording in one ID tag to integrate plural parts, and to record combined characteristic decided by the combination and centralizing the management are effective like this embodiment. In addition, the number of parts of the ID tag can be decreased, and the mounting locations also can be decreased.

EMBODIMENT 14

Next, a method of reading/writing the record of the ID tag is explained.

The record of an ID tag can be read/written, deleted, and be added like a semiconductor memory (Flash ROM). There are possibilities that the data may be destroyed or the wrong rewriting may be performed by the unnecessary radio wave coming from the outside or the electromagnetic wave in the engine, because the memory is operated by wireless. It should be inhibited that the ID tag is read, written or deleted by means other than the wireless with the pattern of the arbitrary rule decided beforehand.

Figure 38:
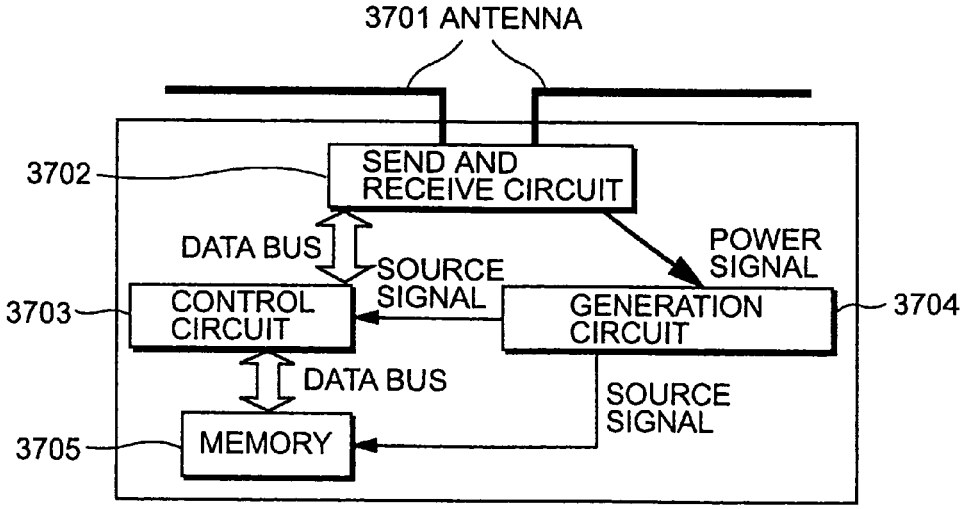
FIG. 38 is a view showing the internal structure of an IC tag.

The structure of the ID tag is explained by using FIG. 38.

The ID tag includes antenna 3701 which receives an electric wave, transmitting and receiving circuit 3702 which transmits and receives the electric wave, control circuit 3703 which exchanges data with transmitting and receiving circuit 3702, memory 3705 which records data, and power generation circuit 3704 which generates the power supply signal to internal control circuit 3703 and memory 3705 based on the electric power signal (Alternating current signal) generated from transmitting and receiving circuit 3702.

Figure 39:
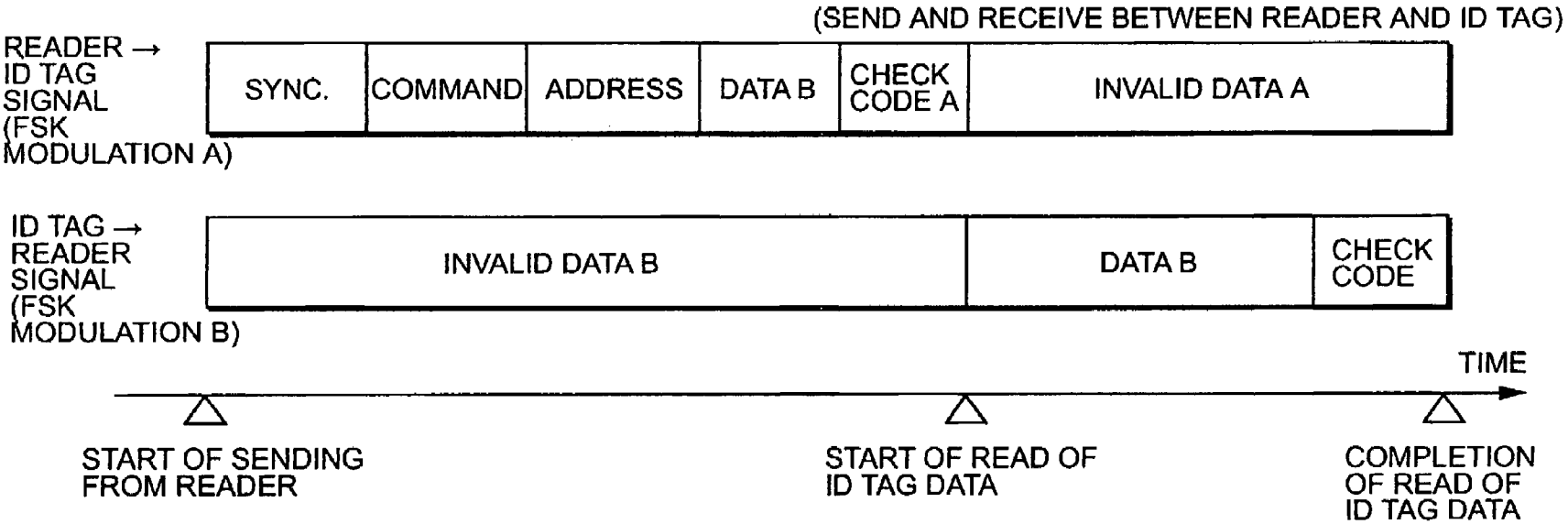
FIG. 39 is a view explaining transmitting and receiving between a reader and the ID tag.

FIG. 39 shows the time base image of the transmitting/receiving of the data between an ID tag and a reader for reading the data from the ID tag. The reader should transmit the electric wave while the ID tag is transmitting the signal to the reader so that the electric power of the ID tag can be generated in power generation circuit 3704 by the electric wave from the reader.

Reader-to-ID tag signal of FIG. 39 (FSK modulation A) has the following areas. That is, a synchronous area to synchronize transmitting and receiving, a command area to show the kind of commands, an address area to specify the address of memory, a data area to reflect data of address like writing operation etc. and a check code area to check the consistency of the entire area. The FSK modulation is expressed by switching at least two kinds of frequencies to express two kinds of data of "0" and "1". The value obtained by calculating the CRC or the checksum of the above-mentioned command area, the memory address area, and the entire data area is set in the check code area. Because invalid area data is an area used to generate electricity for the ID tag, the ID tag side disregards the data of this area.

On the other hand, reader-to-ID tag signal (FSK modulation B) is achieved by FSK modulation B of a different frequency for ID tag to reader signal. The invalidity data in invalid data area B is responded while the signal of the synchronous area, the command area, and the address area is receiving from the reader. After receiving check code A, control circuit 3703 confirms the consistency of data from the reader. When data from the reader is not destroyed by the noise etc., the checksum or the CRC is correctly calculated and the consistency is obtained. In this case, the ID tag sets the data according to the command in data area B, and responds to the reader side after adding check code B in which the calculation of the CRC or the checksum calculated from data B is set. When check code A from the reader is illegal, invalid data is set in data area B. illegal data is added to the data of the area of check code B so that data B of the ID tag may be annulled by the reader.

Four kinds of commands of a reading command, a write enable command, a writing command and a write inhibit command are set as commands given to the ID tag.

The reading command sets "reading instruction" into the command area of reader-to-ID tag signal, and sets "address of data to be read" into the address area. Data B read is set to data area B of ID tag to reader signal. At this time, this content is disregarded in the ID tag side though "arbitrary data" is set in the area of data A.

The write enable command sets "write enable instruction" in the command area of reader-to-ID tag signal, and sets "arbitrary data" in the address area and the area of data A. "Arbitrary data" is set in data B of ID tag to reader signal. The consistency of check code A and check code B should be surely taken though any values are basically acceptable for these "arbitrary data". After this command is issued, the ID tag accepts the writing command.

The write inhibit command sets "write inhibit instruction" in the command area of reader-to-ID tag signal, and sets "arbitrary data" in the address area and the area of data A. "Arbitrary data" is set in data B of ID tag to reader signal. The consistency of check code A and check code B should be surely taken though any values are basically acceptable for these "arbitrary data". After this command is issued, the ID tag does not accept the writing command.

The writing command sets "writing instruction" in the command area of reader-to-ID tag signal, "address of data to be written" in the address area, and "data to be written" in the area of data A. "Arbitrary data" is set in data area B of ID tag to reader signal. The consistent data is set in check code B when correctly written. Illegal data B and the check code are set when it is impossible to write. The correct data is read as it is, and the illegal data is annulled by the reader side.

As mentioned above, because the write enable command and the write inhibit command are prepared for the writing operation, the rewriting operation by the noise, etc. hard to occur in the ID tag.

Moreover, because the data in the memory is fixed by a first writing command if the memory installed in the ID tag is one that can write just for once, the rewriting can not performed even if the writing command is transmitted in such a case. In this case, only two kinds of commands, the writing command and the reading command are set.

The above-mentioned method is a method of prohibiting an easy data rewriting by using the logic of "write inhibit and write enable" installed in the ID tag.

EMBODIMENT 15

Figure 40:
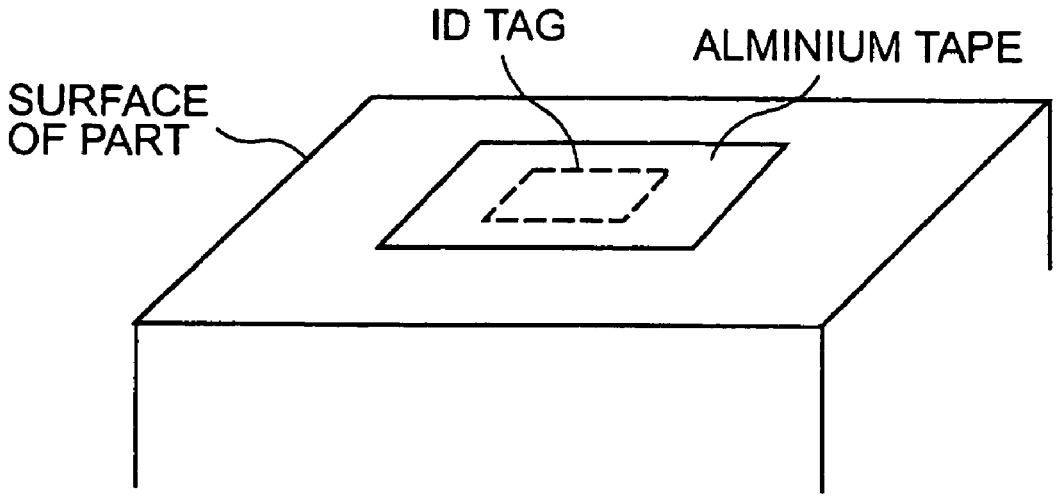
FIG. 40 is a view showing a first method of prohibiting writing by intercepting an electric wave.
Figure 41:
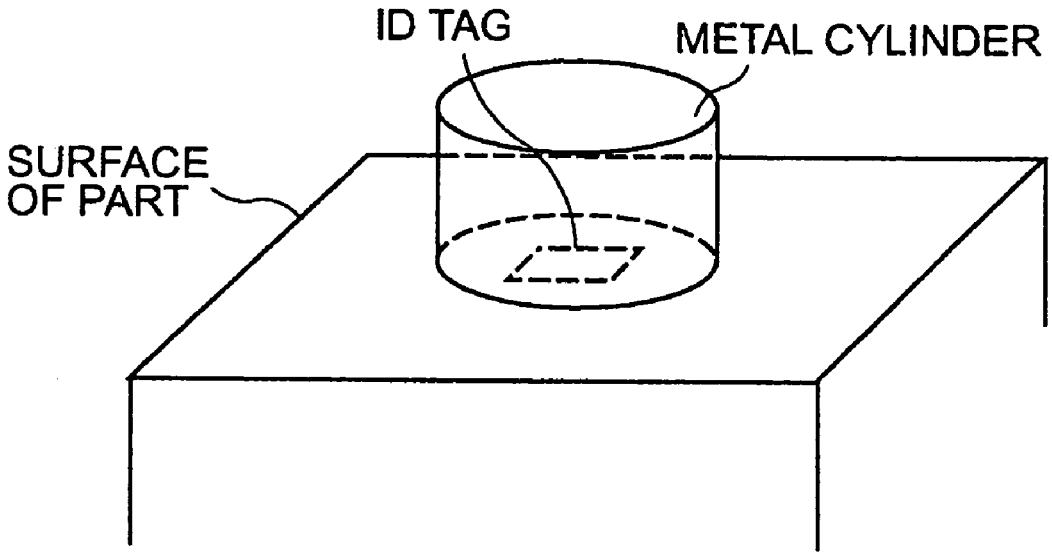
FIG. 41 is a view showing a second method of prohibiting writing by intercepting an electric wave.

A method of intercepting all electric waves from the reader side by installing the cover made of the material to which the electric wave does not penetrate in the ID tag mounted on the device may be adopted as another means for prohibiting the rewriting. A method of putting thin film of metallic member such as aluminum tapes in front of ID tag as shown in FIG. 40, and a method of putting the cover of a metallic cylinder as shown in FIG. 41 (If it is a cover that the ID tag is hidden between the components side and the cover with no space, any shapes are adopted) may be adopted. The reading or writing becomes possible by detaching the thin film or the cover.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A fuel injection valve, comprising an information storage part for information corresponding to an injection amount characteristic, wherein the information stored in said information storage part are values of dynamic injection amounts corresponding to widths of a plurality of injection command pulses, an area where a dynamic injection amount is small and an area where a dynamic injection amount is large are defined based on whether values of dynamic injection amounts are respectively small or large, and an interval of the set points of the widths of the plural injection command pulses in the area where a dynamic injection amount is small is relatively smaller than an interval of the widths of the plural injection command pulses in the area where dynamic injection amount is large.

2. A fuel injection valve of claim 1, wherein values of dynamic injection amounts corresponding to the set points of the widths of the plural injection command pulses and values of static injection amounts are stored in said information storage part.

3. A fuel injection valve of claim 1 further comprising a resin connector part that projects outside of an engine when installed, wherein an information storage element and a transmitter-receiver are integrally molded in said resin connector part.

4. A fuel injection valve of claim 1, wherein the area where a dynamic injection amount is small the area where a dynamic injection amount is intermediate, and the area where a dynamic injection amount is large are defined based on whether values of dynamic injection amounts are small, intermediate or large, the interval of the set points of the widths of the plural injection command pulses in the area where a dynamic injection amount is relatively smaller than an interval of the widths of the plural injection command pulses in an area where dynamic injection amount is intermediate, and the interval of the set points of the widths of the plural injection command pulses in the area where the intermediate dynamic injection amount is relatively smaller than the interval of the widths of the plural injection command pulses in the area where dynamic injection amount is large.

5. A control apparatus for a fuel injection valve having an information storage part for showing information corresponding to an injection amount characteristic, comprising the fuel injection valve of claim 1 configured for storing the injection amount characteristic in which a dynamic injection amount does not increase monotonically in the information storage, such that, with a plurality of widths of injection command pulses for obtaining a dynamic injection amount corresponding to a value of dynamic injection command amount, an injection amount is controlled by obtaining a width of injection command pulse corresponding to the value of injection command pulse corresponding to the value of dynamic injection command amount by selecting a point where a change rate in the dynamic injection amount with respect to the width of injection command pulse is minimum.

* * * * *